US008511802B2

(12) United States Patent
Odin

(10) Patent No.: US 8,511,802 B2
(45) Date of Patent: Aug. 20, 2013

(54) DIRECTLY DETECTION DEVICE OF TRAJECTORIES OF DROPS ISSUING FROM LIQUID JET, ASSOCIATED ELECTROSTATIC SENSOR, PRINT HEAD AND CONTINUOUS INK JET PRINTER

(75) Inventor: Florence Odin, Montelier (FR)

(73) Assignee: Markem-Imaje, Bourg-les-Valence (FR)

( * ) Notice: Subject to any disclaimer, the term of this patent is extended or adjusted under 35 U.S.C. 154(b) by 0 days.

(21) Appl. No.: 13/387,354

(22) PCT Filed: Jul. 28, 2010

(86) PCT No.: PCT/EP2010/060942

§ 371 (c)(1),
(2), (4) Date: Apr. 5, 2012

(87) PCT Pub. No.: WO2011/012641

PCT Pub. Date: Feb. 3, 2011

(65) Prior Publication Data

US 2012/0182362 A1 Jul. 19, 2012

Related U.S. Application Data

(60) Provisional application No. 61/243,513, filed on Sep. 17, 2009.

(30) Foreign Application Priority Data

Jul. 30, 2009 (FR) ..... 09 55362

(51) Int. Cl.
*B41J 2/125* (2006.01)

(52) U.S. Cl.
USPC ..... 347/81

(58) Field of Classification Search
USPC ..... 347/73–82
See application file for complete search history.

(56) References Cited

U.S. PATENT DOCUMENTS 3,886,564 A 5/1975 Naylor et al.
3,898,673 A * 8/1975 Haskell ..... 347/90

(Continued)

FOREIGN PATENT DOCUMENTS

EP 0 036 789 9/1981
EP 0 362 101 B1 4/1990

(Continued)

OTHER PUBLICATIONS

International Search Report and Written Opinion for International Application No. PCT/EP2010/060942, dated Nov. 19, 2010, in 14 pages.

(Continued)

*Primary Examiner* — Kristal Feggins
(74) *Attorney, Agent, or Firm* — Knobbe Martens Olson & Bear LLP

(57) ABSTRACT

Systems and methods for detection of the directivity of trajectories of charged drops issuing from a jet are disclosed. According to one aspect, an electrostatic sensor is disclosed which includes a flat functional surface. The electrostatic sensor is configured to function in a non-differential manner and has a geometric shape and arrangement that are substantially aligned relative to a nominal trajectory of drops. A trajectory of drops can be followed at the same time in a plane parallel to the flat surface of the sensor and in a plane perpendicular to the flat surface of the sensor. As a result, it can be verified whether a drop is present or remains in a predefined monitoring zone. According to another aspect, a method of controlling trajectories of drops in a print head having a continuous deflected jet, and a method of monitoring the effective recovery by the gutter of drops not intended for printing are disclosed.

26 Claims, 8 Drawing Sheets

(56) References Cited

U.S. PATENT DOCUMENTS

| | | | | |
|---|---|---|---|---|
| 4,255,754 | A * | 3/1981 | Crean et al. | 347/81 |
| 4,308,543 | A * | 12/1981 | Shultz | 347/90 |
| 4,333,083 | A | 6/1982 | Aldridge | |
| 4,434,428 | A | 2/1984 | Horike et al. | |
| 4,551,731 | A | 11/1985 | Lewis et al. | |
| 4,636,809 | A | 1/1987 | Eremity | |
| 5,160,939 | A * | 11/1992 | Bajeux et al. | 347/78 |
| 6,357,860 | B1 | 3/2002 | Rhodes | |
| 6,504,375 | B1 | 1/2003 | Werner | |
| 6,758,555 | B2 * | 7/2004 | Bajeux | 347/77 |
| 6,883,904 | B2 * | 4/2005 | Jeanmaire et al. | 347/82 |
| 7,837,307 | B2 * | 11/2010 | Schmitt | 347/77 |
| 8,226,199 | B2 * | 7/2012 | Hawkins et al. | 347/81 |
| 2002/0118258 | A1 | 8/2002 | Bajeux | |
| 2003/0020777 | A1 | 1/2003 | Su et al. | |
| 2004/0051155 | A1 | 3/2004 | Oka | |
| 2005/0206688 | A1 * | 9/2005 | Gelbart et al. | 347/74 |
| 2005/0280676 | A1 * | 12/2005 | Rybicki et al. | 347/76 |
| 2006/0267578 | A1 | 11/2006 | Ushijima | |

FOREIGN PATENT DOCUMENTS

| | | |
|---|---|---|
| EP | 1 705 017 A2 | 9/2006 |
| FR | 2 821 291 | 8/2002 |

OTHER PUBLICATIONS

French Preliminary Search Report for French Patent Application No. 0955362 dated Apr. 19, 2010.

* cited by examiner

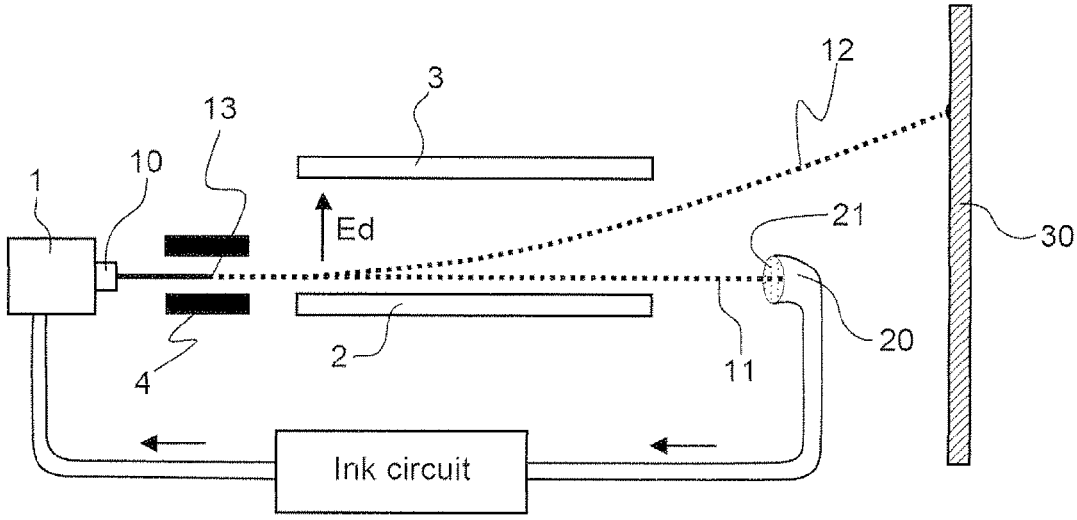
FIG.1
FIG.2A
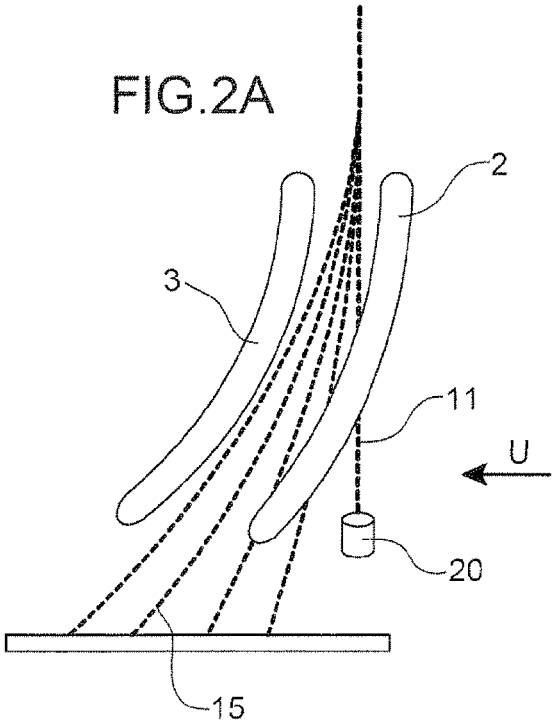
FIG.2B
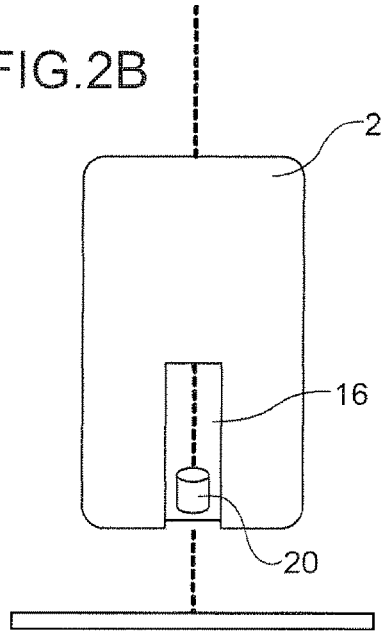

FIG.4
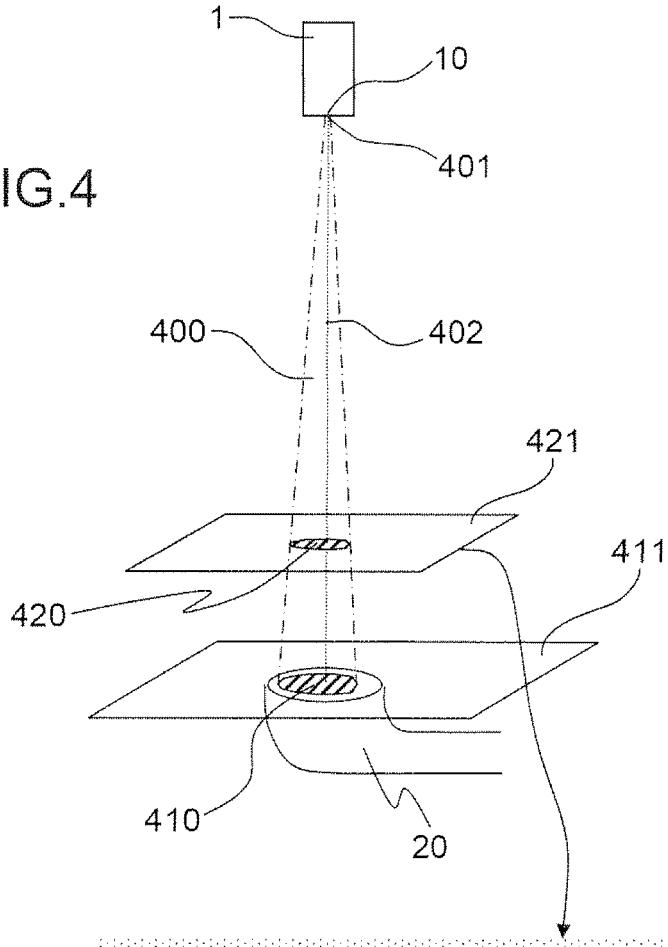
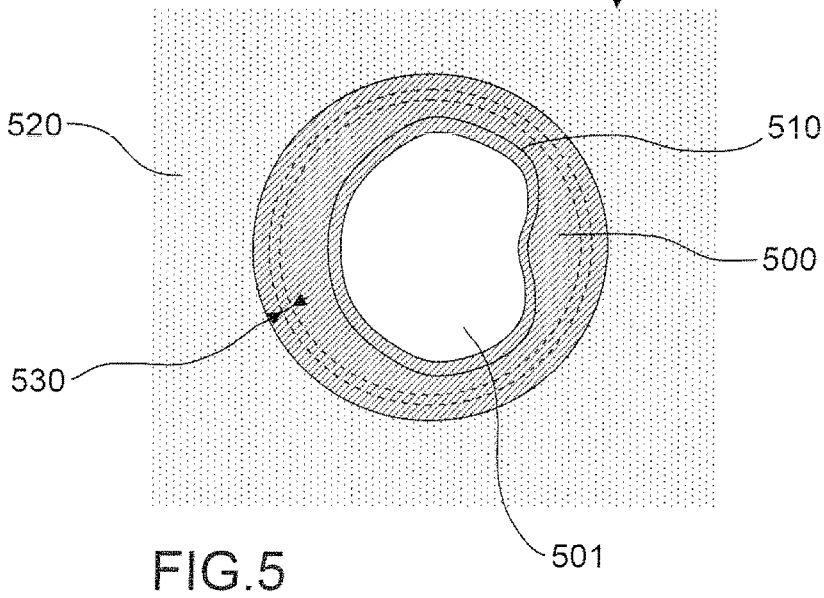
FIG.5

FIG.8A
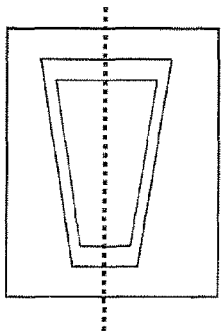
Position of a centered jet
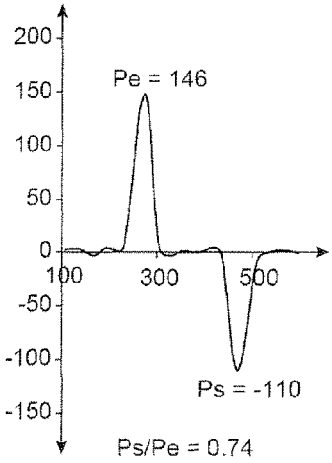
FIG.8B
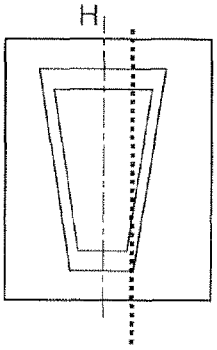
Position of a jet at x = 600µm
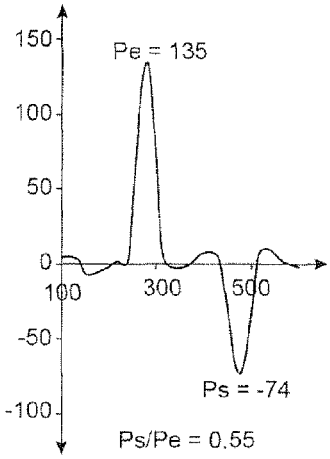
FIG.8C
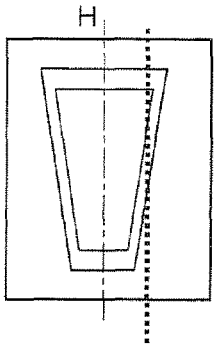
Position of a jet at x = 900µm
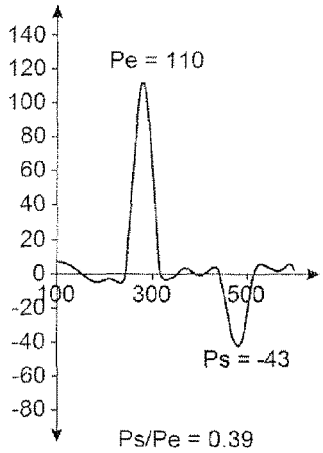
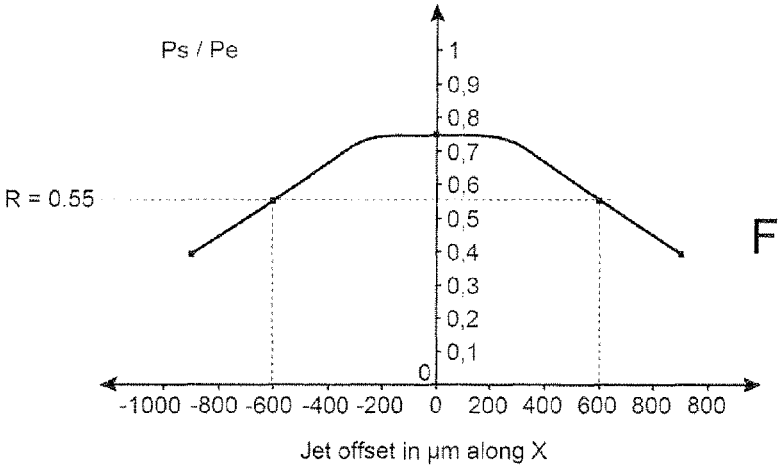
FIG.8D

DIRECTLY DETECTION DEVICE OF TRAJECTORIES OF DROPS ISSUING FROM LIQUID JET, ASSOCIATED ELECTROSTATIC SENSOR, PRINT HEAD AND CONTINUOUS INK JET PRINTER

RELATED APPLICATIONS

This application is a U.S. National Phase of International Application No.: PCT/EP2010/060942, filed Jul. 28, 2010, which claims the benefit of U.S. Patent Application No. 61/243,513 filed Sep. 17, 2009 and French Patent Application No. 09 55362 filed Jul. 30, 2009, each of which is incorporated by reference in their entirety.

FIELD OF THE INVENTION

The invention relates to a directivity detection device of trajectories of drops issuing from a liquid jet.

More particularly, it deals with control of the functioning of a continuous ink jet print head.

The invention detects whether the drops not printed and issuing from a continuous ink jet are effectively or not directed to the recovery gutter of these drops. It likewise determines the charge synchronisation of drops and allows to know the speed of drops issuing from the continuous jet.

The invention likewise relates to an associated electrostatic sensor, print head and printer with continuous ink jets.

CONVENTIONAL ART

Continuous ink jet printer heads comprise functional means well known to the person skilled in the art.

FIG. 1 illustrates such a print head according to the prior art. This head essentially comprises the following functional means, described successively in the direction of progression of the jet:

- a drop generator 1 containing electrically conductive ink, kept under pressure by an ink circuit, and emitting at least one ink jet 11,
- an individual charge electrode 4 for each ink jet,
- an assembly constituted by two deflection plates 2, 3 placed on either side of the trajectory of the jet and downstream of the charge electrode 4,
- a recovery gutter 20 for collecting the jet ink not used for printing so as to be returned to the ink circuit and thus be recycled.

The functionality of these different means is described herein below. The ink contained in the drop generator 1 is issued from at least one calibrated nozzle 10 forming at least one ink jet 11. Under the action of a periodic stimulation device placed upstream of the nozzle (not illustrated), constituted for example by a piezo-electric ceramic placed in the ink, the ink jet breaks off at regular time intervals, corresponding to the period of the stimulation signal, at a precise point of the jet downstream of the nozzle. This forced fragmentation of the ink jet is usually caused at a so-called "break-up" point 13 of the jet by periodic vibrations of the stimulation device. At the location of this break-up point the continuous jet transforms into a spatial sequence 11 of evenly spaced identical ink drops. This drop sequence is directed according to a trajectory colinear to the axis of ejection of the jet which theoretically joins the centre of the recovery gutter 20, by geometric construction. Without the effect of external forces, the real trajectory of the drops follows a so-called "static" direction which can be slightly different from the theoretical direction in question, on the one hand because of the imprecisions in manufacture which produce an error of fixed orientation, and on the other hand, due to a drift of the orientation of the jet during operation due to changes in operating conditions of the jet by the nozzle. These changes can be caused in particular by modification of the surface conditions in and around the nozzle caused by accumulation of ink fouling. This problem becomes particularly sensitive after long periods of operation of the printer.

The charge electrode 4, located near the break-up point of the jet, is intended to selectively charge each of the drops formed at a predetermined electric charge value. To do this, with the ink being kept at a fixed electrical potential in the drop generator, a determined electric tension is applied to the charge electrode, different to each drop period. In order for the drop to be charged correctly, the instant of application of the electrical tension must take place slightly prior to instant of break up of the jet so that the electric continuity of the jet is ensured and a given quantity of charges is attracted by electrostatic influence to the tip of the jet. It is therefore necessary to synchronise perfectly the instant of application of the charge tension with the breakup process of the jet.

The two deflection plates 2, 3 are electrically driven to a relative fixed potential of a high value which produces an electrical field Ed substantially perpendicular to the trajectory of the drops. This field can deflect the electrically charged drops which engage between the plates, by an amplitude which is a function of their charge and of the speed of these drops. These deflected trajectories 12 are not collected by the gutter 20 and impact the medium to be printed 30. The placement of the drops on the drop impact matrix to be printed on the substrate is obtained by the combination of individual deflection given to the drops of the jet with relative displacement between the head and the medium to be printed. These two deflection plates 2, 3 are in general flat. One of them can also have an incurved profile or can be arranged at a certain angle. A more elaborate construction is that revealed in application FR 2 821 291 filed by the applicant and illustrated in FIGS. 2A and 2B, which are respectively a frontal view of the print head and a side view according to the direction U of FIG. 2A. In this construction, the two plates are curved and substantially parallel to one another. The plate 2 is concave relative to the median trajectory 15 of the drops while the plate 3 is convex relative to the median trajectory 15. The concave plate 2 is kept at zero potential and is fitted with a slot 16 to let the non-deflected or weakly deflected drops pass. Such an arrangement of plates is highly effective for deflecting drops as the electrical deflecting field remains substantially perpendicular to the trajectories irrespective of the angle of deflection.

The recovery gutter 20 comprises at its inlet an opening 21 whereof the effective section is the projection of its inlet surface onto a plane perpendicular to the nominal axis of the non-deflected jet, placed just upstream in contact with the gutter. In the context of the invention this plane will be called an inlet plane of the gutter. Within the scope of the invention the nominal axis of the non-deflected jet is understood to mean the theoretical axis of the jet when all the sub-assemblies of the head are manufactured and placed relative to one another nominally once the head is assembled. In a print head with curved plates such as described in application FR 2 821 291, the gutter 20 can be positioned more upstream than the lower end of the deflection plates 2, 3 due to the presence of the slot 16, as illustrated in FIG. 2B. This upstream positioning further reduces the flight distance of the drops in the head and thus makes accurate control of the deflection of the drops easier. The performance of the printer, especially the printing quality, is consequently improved by greater placement precision of the drops.

It is known that control of the functioning of a continuous jet print head further requires functional means described earlier, using a certain number of complementary means allowing on the one hand deflection of the drops (which is determined to a large part by the electric charge and the speed of the drops) to be controlled and on the other hand the monitoring of the proper functioning of the recovery of non-printed drops.

With respect to controlling deflection of the drops, it is known to implement dedicated means especially to ensure, on the one hand, synchronised application of the charge signal of the drops with the instant of break-up of the jet (called synchronisation of the charge), and on the other hand, to measure the speed of the drops Vg in order to servo control it them to a preset value. To do this, the print heads according to the prior art generally comprise a measuring device of a representative magnitude of the charge carried by the drops. This measuring device is arranged downstream of the charge electrode. As this charge measuring is carried out, in general, when the specifically charged drops pass in front of this device, the method usually adopted to select the synchronisation instant of the charge relative to the break-up consists of performing repeated trials for changing sequences of drops with a succession of electrical charge signal of shorter duration than the drop period, but with different charge instants (also called "phases") differently distributed throughout a drop period, and for each assigned phase, to measure the level of charge carried by the drop. The charge level is representative of the efficiency of the charging process of the drops and therefore of the suitability of the charge synchronisation. Some phases produce mediocre or even very poor charge synchronisation, but in general, a certain number of phases permits maximum charge. The charge phase to be used in printing will be selected from the latter. According to the solutions operated for measuring the charge of the drops in view of charge synchronisation, it is generally possible to deduce, in addition to these measurements of charge of the drops, an effective measurement of the speed of the charged drops. In fact, by detecting certain characteristic instants corresponding to the presence of drops identified at different characteristic geometric locations of the print head, it is possible to deduce there from an average travel time of the drops between these known locations, and therefore an average speed of the drops between these locations.

Among all the devices of the prior art, electrostatic sensors are generally used to fulfil this function.

Such a sensor is described for example in U.S. Pat. No. 6,357,860 assigned to Linx company and is constituted by two flat electrodes spaced along the trajectory of drops and forming an integral part of one of the deflection plates. This double-electrode sensor provides a signal when charged drops pass in front of each electrode: the amplitude of the signal is representative of the quantity of embedded charge per drop and the time offset between detection by each of the two electrodes give the duration of flight. The speed of the drops of the jet between these two points whereof the separation distance is known can thus be deduced. The advantage of this solution of sensors placed at the level of the deflection plates is to not increase the distance of flight of the drops in the head between the ejection nozzle and the medium to be printed. On the contrary, the disadvantage here is to expose the sensor to significant electrostatic perturbations, especially generated by the noise produced by the circulation of charged drops in the internal environment of the print head and by the noise emitted by the different internal components of the head, which are subjected to variable or noisy electric voltages. These conditions do not allow very precise measurements due to the very noisy signal of the sensor.

Patent EP 0 362 101 B1 in the name of the applicant describes a single electrostatic sensor placed between the charge electrode and the deflection plates, as well as the processing of the associated signal. The sensitive core of this sensor and the circulation space of the charged drops in front of this sensitive core are protected from electrostatic perturbations by electrostatic shielding. The presence of specifically charged drops is detected by their electrostatic influence on the sensitive core of the sensor. The exploitation of the signal obtained from these drops passing in front of this sensor takes very precise measurements of the charge level of these drops and defines the instants of their entry to and exit from the sensor, therefore the transit duration of these drops in the detection zone of the sensor. If the effective length of the zone travelled through is known, the average speed of the drops passing in front of the sensor can be deduced.

With respect to monitoring of the collection of non-printed drops, it is known to use dedicated means to detect that the ink not used for printing is properly recovered. If this ink escapes the gutter, the jet must be stopped to avoid fouling of the print head and its environment, fouling being generally unacceptable to the user of the printer. These problems can be created by deficiency of the recovery device which is incapable of evacuating the ink of the non-printed drops or by abnormal behaviour of the jet. In fact, the orientation of the jet can vary, such as for example be set at start-up at a value different to the nominal value or can move away from the nominal value during operation. No functional problem occurs as trajectories of the drops not intended for printing reach the interior of the gutter. On the contrary, dysfunctioning appears when the trajectory of the jet exits from the gutter or when drops strike its edge. Recovery detection can be done in different ways, especially by analysis of the resistivity of the fluid vein of the return circuit of the ink immediately downstream of the inlet of the gutter. Unfortunately, the system can be faulty since it cannot generally make the difference between the case of correct functioning and that where the jet, when improperly oriented, strikes the edge of the gutter. In this case, part of the ink enters the gutter to create the conditions which the resistivity sensor will interpret as a jet partially recovered by the gutter, a situation also characteristic of normal printing. So, in a situation where the jet is improperly oriented all or part of the ink of the jet contaminates the immediate environment of the edge of the gutter, or flows inside the gutter, which generally results in major dysfunction after it accumulates. The detection of correct recovery of the ink inside the gutter is therefore not reliable with solutions of the prior art.

This is why a certain number of solutions using sensors for locating the drops in this case has already been proposed. The localisation of ink drops by physical contact on a pressure sensor or by means of optical barriers is not reliable under industrial conditions of use of ink jet printers, due in particular to the sensitivity of such solutions to fouling by ink.

Other solutions according to the prior art consist in using electrostatic sensors, in so far as the liquid which makes the drops have come is conductive, the latter able to be charged electrically. The general principle uses the property according to which the level of the signal detected by an electrostatic sensor, during the passage of electric charges, depends on the distance between the active surface of the sensor and the charged drops. The localisation principle of the charged drops according to the state of the art consists in using two electrostatic sensors placed symmetrically on either side of the trajectory of drops the spacing of which relative to a nominal trajectory is to be evaluated. The difference in amplitude of the current signals delivered when charged drops pass in front of the sensors indicates the real position of the drops relative to the sensors in a certain single direction.

U.S. Pat. No. 3,886,564 assigned to IBM company describes several types of arrangement of pairs of electrostatic sensors, delivering signals whereof the differential processing determines the relative position of the drops passing in front of the sensors. The detection of position of charged drops in two directions defining a plane cutting the trajectory of these drops requires an arrangement of four electrostatic sensors arranged in two pairs and the implementation of electronics and the associated signal processing.

U.S. Pat. No. 4,551,731 and EP 0 036 789 assigned to Cambridge Consultants company describe this type of arrangement definitively requiring four sensors per trajectory of drops to be monitored for evaluating the drift, in two directions of the real trajectory of the drops relative to a nominal trajectory in passing in front of the sensors. Using this principle on a continuous ink jet print head leads to complex, bulky and costly implementation. This realisation causes other disadvantages:

- on the one hand, the use of four sensors placed around the jet cannot be done without partially masking visibility the jet which is confined at the level of the sensors in a narrow space, difficult to access for maintenance of the print head, especially for cleaning the charge or deflection elements;
- on the other hand, the means which are dedicated to measuring the orientation drift of the jet must be inserted along the trajectory of the jet between the nozzle and the recovery gutter. The intrinsic bulkiness of the sensors generates problems of physical integration and tends to increase the distance of flight of the drops between their charge and their impact locations on the medium to be printed. The drawback is that a long distance of flight of drops impairs position precision of impacts and therefore the printing quality.

In summary, the major disadvantages of recovery detection solutions of drop coming from liquid jet according to the prior art are the following:

- detection of the passage of the ink in the gutter by means of a sensor analysing the ink flow in the fluid vein in the gutter is not enough to prevent pollution risks because when the jet strikes the edge of the gutter it is not detected as a defect situation,
- evaluation of the real position of the drops, at the level of a plane perpendicular to the nominal trajectory of the jet and in the vicinity of the inlet of the gutter, is possible with solutions of the art using several pairs of electrostatic sensors but at the price of significant bulkiness and at prohibitive cost;
- arrangement of two pairs of electrostatic sensors around the jet makes it very difficult to access the different functional means of the head for maintenance, especially for cleaning;
- using sensors dedicated to measuring orientation shifts of the jet on the trajectory of the jet makes the drop flight paths longer in the print head to the detriment of the print quality;
- using electrostatic sensors easily perturbated by noise coming from different electric signals of the print head and from electric charges in movement in the print head affects measurement precision. It is frequently necessary to either create effective shielding, often in a bulky manner, of the sensitive parts of the sensor, or to perform additional processing of the signal produced, which proves costly.

The aim of the invention is therefore to eliminate the drawbacks of the prior art.

A particular aim of the invention is to propose a reliable and inexpensive solution for detection of the directivity of trajectories of ink drops issuing from a continuous jet in a print head, which ensures rapid detection of operating defects and optimal management of these possible defects to limit the harmful consequences for the user of the printer equipped with the head.

SUMMARY AND DESCRIPTION OF ASPECTS OF THE INVENTION

To do this, the invention relates to a directivity detection device of trajectories of drops issuing from liquid jet, the drops being charged electrically.

The device according to the invention comprises an electrostatic sensor comprising a portion for electric charge detection, made of electrically conductive material, said sensitive zone, surrounded by a portion made of electrically insulating material, said insulating zone, itself surrounded by a portion made of electrically conductive material and connected to earth to create electric shielding, said shielding zone; the zones of the sensor delimiting at least one continuous flat surface, the sensitive zone of the sensor comprising at least four edges including an upstream edge and a downstream edge connected to one another by two lateral edges, the arrangement of the sensor being such that:

- the upstream and downstream edges are substantially perpendicular to the direction of the nominal trajectory of the jet and are each cut into two segments by the straight line H which is the geometric projection of the nominal trajectory on the flat surface perpendicularly to the latter;
- for each of the sides of the sensor delimited by the straight line H, the segment of the upstream edge and the segment of the downstream edge are of different lengths, the length of the longer segment being at least equal to the maximum permissible amplitude of the offset of trajectories to the side of the straight line H considered, relative to the nominal trajectory and the length of the shorter segment being at most equal to the maximum permissible amplitude of the offset of trajectories to the side of the straight line H considered, relative to the nominal trajectory.

The device likewise comprises means to process electrical signals created by the electrical charges of the drops in movement that are detected by the sensor, said means being adapted respectively for:

- evaluating the level of the inlet peak Pe and of the outlet peak Ps of the representative signal of the electrical current derived from an electrical charge in movement detected respectively at the level of the upstream edge and of the downstream edge of the sensor, and
- calculating the value of a representative function of the difference between the levels of Pe and Ps (for example in absolute value either the ratio Pe/Ps or the subtraction Pe−Ps),
- making a first comparison of the value of said function with at least one first predetermined constant value or a range of predetermined values,
- making a second comparison of the level of the highest inlet peak Pe or outlet peak Ps relative to one another with at least one second predetermined constant value, the predetermined values being characteristic of the nominal trajectory of the drops.

In the device according to the invention, the first comparison allows to know the actual position of a trajectory of drops in the plane parallel to the flat surface of the sensor and the second comparison allows to know the actual position of the same trajectory of drops in the plane perpendicular to the flat surface of the sensor.

It is specified here that within the scope of the invention the terms "upstream" and "downstream" must be understood by reference to the direction of flight of the drops issuing from liquid jet. Accordingly, the upstream edge of the sensitive zone is the part of the sensitive zone in front of which a given drop first passes.

Similarly, the term "height" is to be understood by reference to the direction of flight of the drops issuing from liquid jet: the height of the sensor zones according to the invention is the dimension according to the straight line H which is the projection of the nominal trajectory.

Advantageously, the signal-processing means comprise means to evaluate the time-interval T between the inlet peak Pe and the outlet peak Ps to deduce therefrom the speed of the drops Vg at the level of the sensor. In fact, from knowing the effective length Leff of a sensor according to the invention, it is possible to deduce the speed of the drops by the relationship Vg=Leff/T. As specified herein below, the effective length is defined substantially as being the distance separating the centres of the two strips of the insulating zone whereof one is situated adjacent to the upstream edge of the sensitive zone and whereof the other is situated adjacent to the downstream edge of the sensitive zone.

According to an embodiment, the arrangement of the sensor is such that its sensitive zone is symmetrical relative to the straight line H which is the geometric projection of the nominal trajectory of drops.

According to an alternative, the arrangement of the sensor is such that its sensitive zone is non-symmetrical relative to the straight line H, which is the geometric projection of the nominal trajectory of drops.

Thus, detection according to the invention can be implemented with a sensitive zone not necessarily symmetrical relative to the straight line H. In other terms, the electrostatic sensor according to the invention can have a non-symmetrical shape but with an arrangement such that the upstream edge and the downstream edge are substantially parallel to one another and the segments of each of these edges located on the same side of the straight line H have different lengths.

According to one characteristic, the difference in length, in absolute value, between the segment of the upstream edge and the segment of the downstream edge located on the same side relative to the straight line H is at least greater than one diameter of the drops.

The arrangement of the sensor is advantageously such that its flat surface is distant from the nominal trajectory of the drops by a distance comprised between twice the diameter of the drops and the height of the sensitive zone of the sensor. The distance between the drops of the nominal trajectory and the flat surface of the sensor is the result of a compromise to be found for making reliable the detection while functioning in a harsh environment.

Therefore, in the internal environment of a continuous ink jet printer head it is necessary to find a balance between two technical necessities:

on the one hand, the non-deflected ink jet must be far enough from the flat surface of the sensor to best limit the fouling risks of this surface by the ink itself. These risks are linked to possible instability of the jet at start-up or, possibly, to the production of micro-droplets accompanying the jet if the break-up of the latter has not a very good quality. These risks are greater with increase the intrinsic distance between the ejection nozzle of the drop generator and the electrostatic sensor according to the invention;

on the other hand, the drops must pass as closely as possible to the flat surface of the sensor to produce good signal/noise ratio and therefore precise measurements.

The height of the sensitive zone is advantageously between 3 and 100 times the distance between successive drops in the jet.

The height of the insulating zone enclosing the sensitive zone at the level of the upstream and downstream edges is between 0.5 and 10 times the diameter of the drops. The selection of the heights of the sensitive and insulating zones produces substantial detection resolution. In fact, these heights are determined to produce on the signal highly distinct inlet and outlet peaks, that is, without possible overlap, and with maximum amplitude for given drop characteristics (length of the train of drops, speed and charge).

Also, the dimension of the flat surface delimited by the sensitive zone must advantageously be relative to the electrostatic influence area of the drops. This area depends on the distance of the drops relative to the sensor according to the invention. In fact, the quantity of charge caused on the sensor must be sufficient to generate a current exploitable by the signal-processing means. According to a preferred embodiment, the width of the sensitive zone is greater than twice the diameter of the drops.

The invention likewise relates to an electrostatic sensor comprising a portion for electric charge detection, made of electrically conductive material, said sensitive zone, surrounded by a portion made of electrically insulating material, said insulating zone, itself surrounded by a portion made of electrically conductive material and connected to earth to create electric shielding, said shielding zone; the zones of the sensor being delimited by at least one continuous flat surface, the sensitive zone of the sensor comprising, in a frontal view of the flat surface, at least two edges substantially parallel to one another, the straight line perpendicular to these edges which passes through the middle of one of these edges cuts the other edge in delimiting two segments of different lengths on either side.

According to an alternative, the invention likewise relates to an electrostatic sensor comprising a portion for electric charge detection, made of electrically conductive material, said sensitive zone, surrounded by a portion made of electrically insulating material, said insulating zone, itself surrounded by a portion made of electrically conductive material and connected to earth to create electric shielding, said shielding zone; the zones of the sensor being delimited by at least one continuous flat surface, the sensitive zone of the sensor comprising at least, in a frontal view onto the flat surface, at least two edges substantially parallel to one another and of different lengths, the straight line perpendicular to these edges which passes through the middle of one of these edges likewise passes through the middle of the other of these edges.

In a frontal view of the flat surface, the sensitive zone of the sensor, according to this embodiment of the invention, has a trapezoidal geometric shape, the insulating zone which surrounds the sensitive zone defining a quasi-homothetic trapezoidal shape.

In a frontal view of the flat surface, the lateral edges of the sensitive zone, which join the two edges parallel to one another, can have a curved, rectilinear or stepped profile. The profile could be selected as a function for best adapting the specification of the detection zone.

With respect to manufacturing an electrostatic sensor according to the invention, a conductive pass through is preferably made in a small insulating plate in a zone intended to be the sensitive surface. The assembly is preferably metallised on the two faces and at least on one edge of the plate, then etched locally to remove the metallisation on the patterns representing the insulating zones of the flat functional surface and to insulate the area where the conductive pass through terminates on the rear face. The shielding of the flat functional surface extends therefore over the majority of the rear face, ensuring optimal electric protection of the sensitive zone. The conductive pass through transfers the electric continuity of the sensitive zone to the rear of the plate where it is taken up by an adapted terminal. The plate is then preferably fixed tightly and in reference on a casing. When the electrostatic sensor according to the invention is implanted in a continuous jet print head, this casing will itself be mounted in reference on the one hand relative to the gutter and on the other hand relative to the nominal trajectory of non-deflected jet (in fact, the mechanical reference structure of the head).

The small insulating plate in which the conductive pass through is made is preferably made of $Al_2O_3$ ceramic at 99.7% purity. It can also be made of any type of insulating material which can be metallised.

The conductive pass through is preferably constituted by a stuck metallic insert, but can also be constituted by a metallised via.

The metallisation step is preferably carried out by depositing thin layers made by metallic vapor deposition. The metallised layers preferably comprise a sub-layer of chrome covered by a layer of gold. Other metallisation techniques leading to the same results can be used.

The etching step of the conductive layer can advantageously be ablation by laser, but can also be chemical etching or machining. The person skilled in the art will ensure that significant precision during this etching step is respected.

The terminal preferably consists of a ribbon cable of "flex" type (printed circuit on flexible Kapton®), connected by conductive adhesion. It can also consist of welded cables or electric connection by conductive spring contacts.

Other technologies are also feasible for manufacturing a sensor according to the invention, such as:

- using cofired multilayer ceramics exploiting LTCC technology ("Low Temperature cofired ceramic");
- traditional manufacturing using mechanical assembling and machining.

The invention likewise relates to a continuous ink jet print head comprising a drop generator fitted with an ink-ejection nozzle from which a continuous jet is issued, a charge electrode arranged downstream of the ejection nozzle for electrically charging drops issuing from the jet, a pair of deflection electrodes spaced apart from one another and arranged downstream of the charge electrode for selectively deflecting the charged drops intended for printing, a recovery gutter for non-deflected drops and at least one electrostatic sensor as described previously.

The deflection electrodes each preferably have an incurved active surface, the active surface of one of them comprising a pass through slot for letting the non-deflected drops pass, the electrostatic sensor being arranged between said slot and the recovery gutter. The deflection electrodes disclosed in patent EP 0 362 101 B1 cited in the preamble are particularly specified.

The electrostatic sensor is arranged preferably close to and upstream of the recovery gutter of non-deflected drops. Thus, the downstream edge of the sensitive zone is preferably distant from the inlet plane of the gutter by a minimum distance between 0.5 mm and 5 mm, for a drop diameter of between 70 μm and 250 μm. In fact, the downstream edge of the sensor must be as close as possible to the opening of the gutter to have maximum precision in the evaluation of the detection surface. This also helps enlarge the sensitive zone to the maximum with gains on several parameters, such as the Signal/Noise ratio, the jet/sensor distance, . . . . On the contrary, there is a risk of fouling when the drops arrive at high speed on contact inside the gutter: droplets can splash out of the gutter and foul the sensor. The sensor must therefore be sufficiently far from the gutter to be out of reach of these splashing droplets. In practice, the compromise of distance defined hereinabove has proven optimal for a drop diameter of between 70 μm and 250 μm, effectively corresponding to the types of drops issuing from a continuous ink jet of a printer. A first arrangement of the sensor made in the print head is such that its flat surface is substantially perpendicular to the deflection plane of the drops and opposite the directions of deflection defined as being the directions between zero deflection trajectory and the plurality of deflection trajectories caused by the deflection electrodes during printing.

Another arrangement made of the sensor is such that its flat surface is substantially parallel to the deflection plane of the drops and to the rear of the ink jet, the front of the ink jet being defined in reference to the front face of the head. With these two arrangements, accessibility for maintenance of the print head is optimal.

There is also the feasibility of using the combination of two electrostatic sensors each arranged in one of the two perpendicular positions mentioned hereinabove. The two sensors are not mandatorily positioned at the same distance from the gutter along the trajectory of the jet. This extends the detection zone in a print head by determining solely, for the two sensors, the representative function of the difference between the levels of the inlet peak Pe and outlet peak Ps. In fact, the evaluation of the distance between the drops and a single sensor is limited by attenuation of the signals and degradation of the signal/noise ratio when the drops move away from the face of the sensor: therefore, using a second electrostatic sensor arranged perpendicularly relative to the first extends the detection zone.

The invention finally relates to a continuous ink jet printer comprising a print head described previously and signal-processing means of the detection device likewise described previously.

The drops detected by the detection device according to the invention are preferably drops called test drops charged by the charge electrode during normal operation of the printer and inserted within a sequence of drops deflected by the deflection electrodes with a view to being printed. The test drops can be charged with inverse polarity to that of the drops deflected with a view to being printed.

The signal-processing means can advantageously be connected to an alarm which is triggered if at least one of the comparisons results in confirming that one of the values or the range of predetermined values has been exceeded, the triggering of the alarm signalling the risk of non-recovery of all the non-deflected ink drops by the gutter.

A printer according to the invention can advantageously comprise means for varying the charge phases of the drops. The signal-processing means are adapted, during variation of the charge phases, to determine the highest peak of the representative signal of the electrical current derived from a charge in movement detected at the level of the same edge of the sensor, the charge electrode then being set during operation of the printer on the charge phase causing this highest peak.

The invention defined hereinabove enables detection and monitoring of the bidirectional displacement of a jet of drops around a nominal trajectory.

In fact, the processing of the signal issuing from an electrostatic sensor according to the invention allows at the same time to evaluate the value of the lateral displacement of drops parallel to the sensor, relative to their nominal trajectory and the distance between the trajectories of these drops and the flat surface of the sensor. This results in evaluation of bidimensional directivity of the drops around a nominal trajectory at the level of the location where the drops pass in front of the sensor.

As specified hereinabove, the invention is applied in a print head and in particular to monitor the trajectories of non-printed drops, to verify that they are well directed to the interior of the gutter. Detection by the sensor of the real location of the trajectory of drops makes possible to trigger an alarm when the drops of the jet have a trajectory too close to the edge of the gutter.

On the other hand, without increasing the complexity of a print head such as described earlier, that is, by using a single electrostatic sensor, the processing of signals from the sensor likewise searches for the best phase of charge synchronisation and measures the speed of drops in the jet.

In the context of a continuous ink jet print head the inventors have thus attempted to ensure via automatic measuring that the jet is directed systematically at the gutter inlet, in determining its real orientation.

BRIEF DESCRIPTION OF THE DRAWINGS

While the present invention is described herein in connection with certain embodiments, it is to be understood that the invention is not limited to the disclosed embodiments, but, on the contrary, is intended to cover various modifications and equivalent arrangements included within the spirit and scope of the appended claims, and equivalents thereof.

Other advantages and characteristics of the invention will be more apparent at the reading of the following detailed description, given in reference to the figures, of the detection device according to the invention in its application in a continuous ink jet print head and to the particular monitoring of the recovery of non-printed drops, in which:

FIG. 1 shows the operating principle of a print head using deflected continuous ink jet (CIJ) technology as per the state of the art;

FIGS. 2A and 2B show respectively in frontal view and side view according to U improved deflection electrodes used in a print head using deflected continuous ink jet technology likewise according to the prior art;

FIG. 4 is a schematic view in perspective of a print head using deflected continuous ink jet technology according to the invention and in this case shows the permissible delimitation of the trajectories of non-printed drops;

FIG. 5 schematically shows a projection of trajectories of drops to be detected in a horizontal plane at the level of an electrostatic sensor according to the invention;

FIGS. 8A to 8C show the rate of signals generated by the sensor according to FIG. 7 as a function of the offset of trajectories of drops parallel to the flat surface of the sensor relative to a nominal trajectory;

FIG. 8D shows the evolution of the absolute value of the ratio Pe/Ps between inlet peak Pe and outlet peak Ps as a function of the offset of trajectories of drops parallel to the flat surface of the sensor according to FIG. 7 relative to a nominal trajectory;

DETAILED EXPLANATION OF PARTICULAR EMBODIMENTS

Figure 3A:
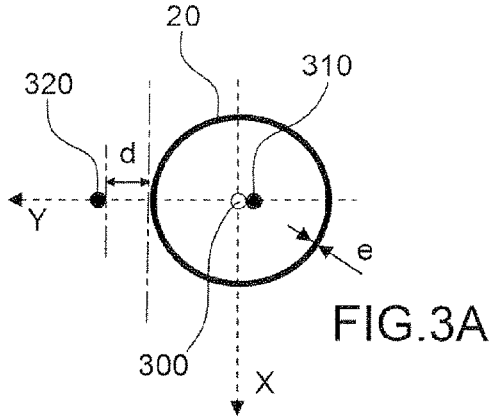
FIGS. 3A to 3E show in a schematic plan view the recovery gutter inlet of a print head using deflected continuous ink jet technology and the zones to be detected according to the invention at the inlet of said gutter.

FIGS. 1 to 2B relative to a print head using deflected continuous ink jet technology according to the state of the art have already been commented on in the preamble, and are not explained here further in terms of the functions of the different means.

The problem with which the inventors have been confronted is the following: theoretically, the trajectory of non-deflected drops referenced by 11 in these FIGS. 1 to 2B is unique and passes through the centre of the inlet 21 of the recovery gutter 20. In fact, as indicated in the preamble of the application, it can eventuate at any instant during printing that the non-deflected drops take different trajectories around this nominal trajectory. This may be due to manufacturing and assembly tolerances of the different functional means of the head, or to the random conditions for setting up the jet at start-up of printing or likewise to progressive fouling, for example of the ejection nozzle, which results in slow change of the orientation of the jet.

The inventors have therefore decided to use a detection device which can locate the passing position of ink charged drops, so-called test drops, across a plane substantially perpendicular to their trajectory and situated between the charge electrode 4 and the recovery gutter 20.

Here, in the embodiment illustrated, the test drops 310 are drops emitted during normal operation of the print head: they are therefore inserted in a sequence of deflected drops intended for printing. Yet, during normal operation of the print head, the deflection plates 2, 3 are permanently fed by continuous high voltage and the deflection field between plates is therefore present throughout the trajectory of the test drops 310. For the test drops 310 to undergo minimal deflection and for them to behave in the closest possible way to non-deflected drops to be monitored (those which must return to the recovery gutter), a minimal charge level is produced with the charge electrode 4. In the mode illustrated, a charge level is placed on the test drops 310 such that their trajectory no longer deflects more than a drop diameter at the level of the sensor, relative to that of the trajectory of non-deflected drops, the directivity of which is to be monitored.

The inventors have first attempted to geometrically define a detection zone. The precise constraints defining the detection zone at the location of the recovery gutter will now be explained in reference to FIGS. 3A to 3E.

These figures illustrate the inlet plane 411 of a gutter whereof the edge has a thickness e, the plane is viewed according to the direction of the nominal theoretical trajectory of the jet. It is specified here that the circular form of the inlet 21 of the gutter illustrated constitutes only one example and that it can take any shape, oval for example. For the sake of clarity, two axes X, Y perpendicular to one another are illustrated in the inlet plane 411: the axis Y is the nominal axis of deflection of the drops (that is, from one deflection electrode 2 to the other 3) and the axis X is an axis directed to the front of the print head. In other words, the axis X is parallel to the flat surface of the sensor and perpendicular to the axis Y. The axes Y and X therefore illustrate a system of axes for defining the relative position of the trajectories of drops relative to the centre of the gutter and relative to the sensor.

In the nominal conditions of FIG. 3A, the circle 300 of diameter identical to that of a drop represents the site where the nominal trajectory issuing from the non-deflected jet passes through the inlet plane 411 of the recovery gutter 20. The circle 310 represents the crossing location of the test drops which, in the case illustrated, are charged with inverse polarity of the printed drops. The trajectory of the least deflected printed drop should likewise be considered; it passes through the inlet plane on the outside of the gutter, at a distance d from the outer edge of the gutter, at a point illustrated by the circle 320.

The relative positions of the points 300, 310 and 320 are largely independent of the orientation of the non-deflected jet and remain identical for any given application.

Figure 3B:
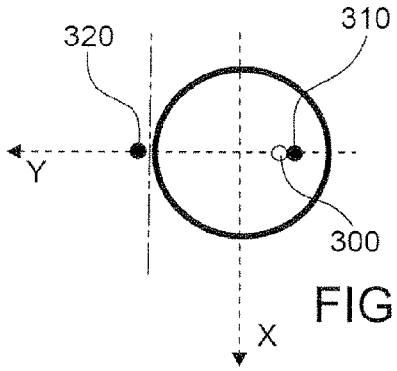
Figure 3C:
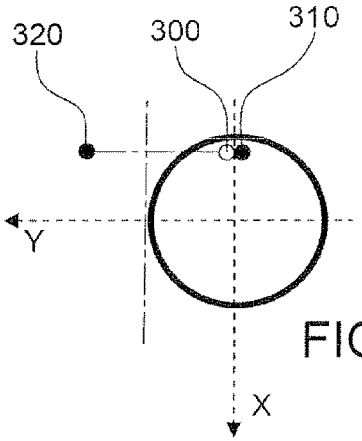
Figure 3D:
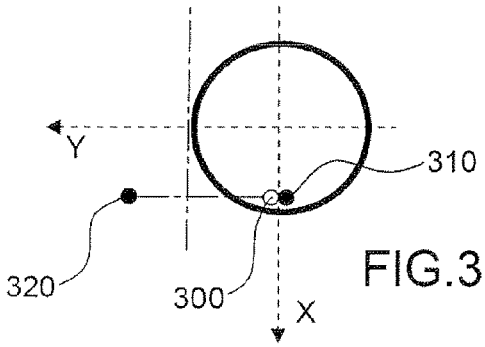

FIGS. 3B, 3C, 3D illustrate three permissible limited situations of an offset of trajectories of the non-deflected jet and intended to be recovered by the gutter 20:

- in FIG. 3B the non-deflected jet 300 is offset by a distance slightly less than d along the negative axis Y: the drops 300 do not make contact with the outer edge of the gutter;
- in FIGS. 3C and 3D the non-deflected jet 300 is offset respectively along the negative and positive axis X: the drops 300 are almost in contact with the internal wall of the gutter.

Figure 3E:
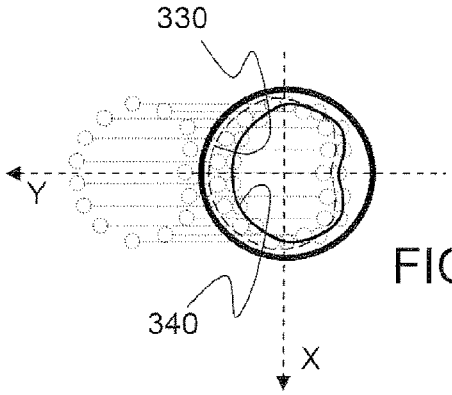

FIG. 3E illustrates all the permissible limited situations in which the non-deflected jet 300 is offset: the exterior of the points of the non-deflected drop 300 facing the inner wall of the gutter defines a surface delimited by the curve 330 in its inlet plane. This curve 330 therefore delimits the surface in which the real non-deflected jet can enter the gutter.

Yet, by definition, an electrostatic sensor can only detect charged drops: the detection zone is therefore the surface delimited by the curve 340 in FIG. 3E. This curve 340 connects the trajectory points of the test drops 310 passing through the inlet plane when the non-deflected jet traverses all the permissible limited situations.

Also, the sensor according to the invention cannot be physically situated at the level of the inlet plane 411 of the gutter due to its intrinsic size: it is therefore located at the level of an intermediate plane situated between the charge electrode 4 and the gutter 20, preferably closer to the latter.

In concrete terms, as evident in FIG. 4, the invention proposes to execute bidimensional directivity monitoring of the non-deflected jet in determining whether its real trajectory is in a space 400 substantially conical whereof the origin 401 is near the ejection nozzle and whereof the axis of revolution 402 corresponds to the nominal trajectory of the non-deflected jet and whereof the transversal maximum section 410 (perpendicular to the axis 402) at the site of the inlet of the gutter 20, is the surface delimited by the curve 330 of FIG. 3E.

In practical terms, this means to detect the passing of test drops 310 through a surface 420 delimited by the intersection of the conical space 400 (defined earlier) and flat plane 421 (parallel to the inlet plane 411) perpendicular to the nominal trajectory 402 of the jet. This surface 420 is the conical projection of the surface 410 on the plane 421. The electrostatic sensor according to the invention is therefore arranged in this plane 421.

FIG. 5 represents the conical projection in the plane 421 of the inlet of the gutter 20 delimited by its wall 530 (in dotted lines) and of the curve 340 projected in a curve 510 defining the detection surface 420. In this projection 510, the hatched part 500 represents the zone where passage of the test drops 310 must trigger an alarm. This zone extends from an inner limit at the surface 420, substantially parallel to the curve 510, at least to the outer edge of the projection of the gutter plus a safety value beyond which the non-printed drops pass clearly to the side of the gutter without touching it. The test drops 310 passing through in the central part 501 of the detection zone (interior of the crown 500) do not trigger an alarm. The inner zone 501 therefore defines a safety or tolerance surface for offsetting the trajectories of a non-deflected jet. If the test drops 310 pass through the outside 520 of the crown 500, no drop enters the recovery gutter 20. This situation of offset of trajectories not detected by the device according to the invention can then be detected by another complementary device. This complementary detection device can for example be a device for analysis of resistivity of the ink vein circulating in the return circuit immediately after the inlet of the recovery gutter.

Figures 6A, 6B:
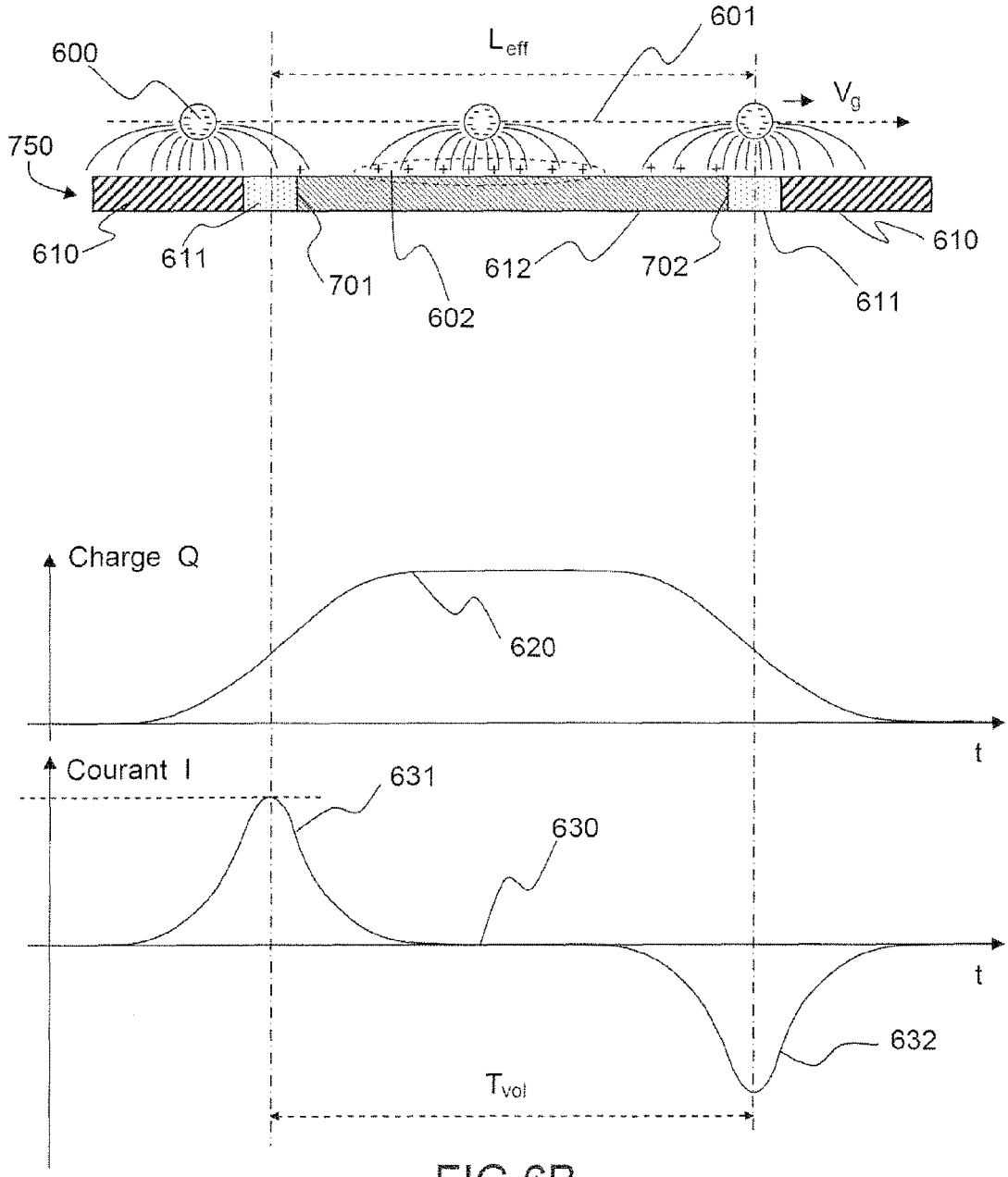
FIG. 6A is a view in longitudinal section of an electrostatic sensor according to the invention and showing different positions of electrically charged drops of the same trajectory close to the sensor as well as their mode of electric influence on the sensor.
FIG. 6B shows a signal of charge evolution as well as a derived current signal generated by the electrostatic sensor when charged drops pass according to FIG. 6A.

The detection device according to the invention is based on the principle of a single electrostatic sensor constituted and arranged such as shown in longitudinal sectional view in FIG. 6A. At its top it is constituted by a portion of conductive electric material which constitutes the sensitive zone 612 separated by a portion made of electrically conductive material and connected to earth to create electric shielding, said shielding zone 610, by a portion made of electrically insulating material said insulating zone 611. These three zones 610, 611, 612 delimit a continuous flat surface. The flat surface 610, 611, 612 of the sensor is arranged close to and in a plane parallel to the trajectory 601 of the drops 600. The upstream 701 and downstream 702 edges of the sensitive zone 612 relative to the direction of progression of the jet are substantially perpendicular to the nominal trajectory of the non-deflected jet.

With the passing of electrically charged drops 600 in the vicinity of the sensor, each drop 600 causes thereon a variation in the quantity of charges per unit surface. This charge variation is illustrated on the curve 620 as a function of the relative position of the charged drop in its direction of displacement (FIG. 6B).

The current circulating between the sensor and the ground, which is the derivative of the charge curve 620 gives a signal whereof the representative curve 630 has a inlet peak 631 and an outlet peak 632, the polarity of the two peaks are opposite.

The dynamic and the level of the signals depend on multiple factors, inter alia: the charge level of the drop, the distance between drops and sensor, the speed of the drop, the width of the insulating zone, the surface of sensitive zone present in the electrostatic influence area of drop. This electrostatic influence area 602, illustrated in FIG. 6A, represents the extent of the field surrounding the drop, influenced significantly by the charges of this drop.

Since the other parameters are fixed, the absolute value of the level of the inlet or outlet peaks is representative of the embedded quantity of charges per drop. For a charge phase correctly synchronised with the instant of break-up of the jet, the levels in absolute value of the peaks are maximum. Their amplitude however depends on the conditions of use of the sensor and the characteristics of the application (ink, jet speed, drop frequency, sequence of test drops 310, . . . ).

Knowing the effective length Leff of the sensitive zone 612 of the sensor gives the average passing speed Vg of the drop in front of the sensor with the formula Vg=Leff/Tvol, by determining the time lapsed Tvol between the instants of extremums of the two inlet and outlet peaks. The effective length is defined within the scope of the invention as being substantially the length between the middles of the two insulating portion zones 610, one situated adjacent to the upstream edge 701 and the other adjacent to the downstream edge 702 of the sensitive zone 612.

Figure 7:
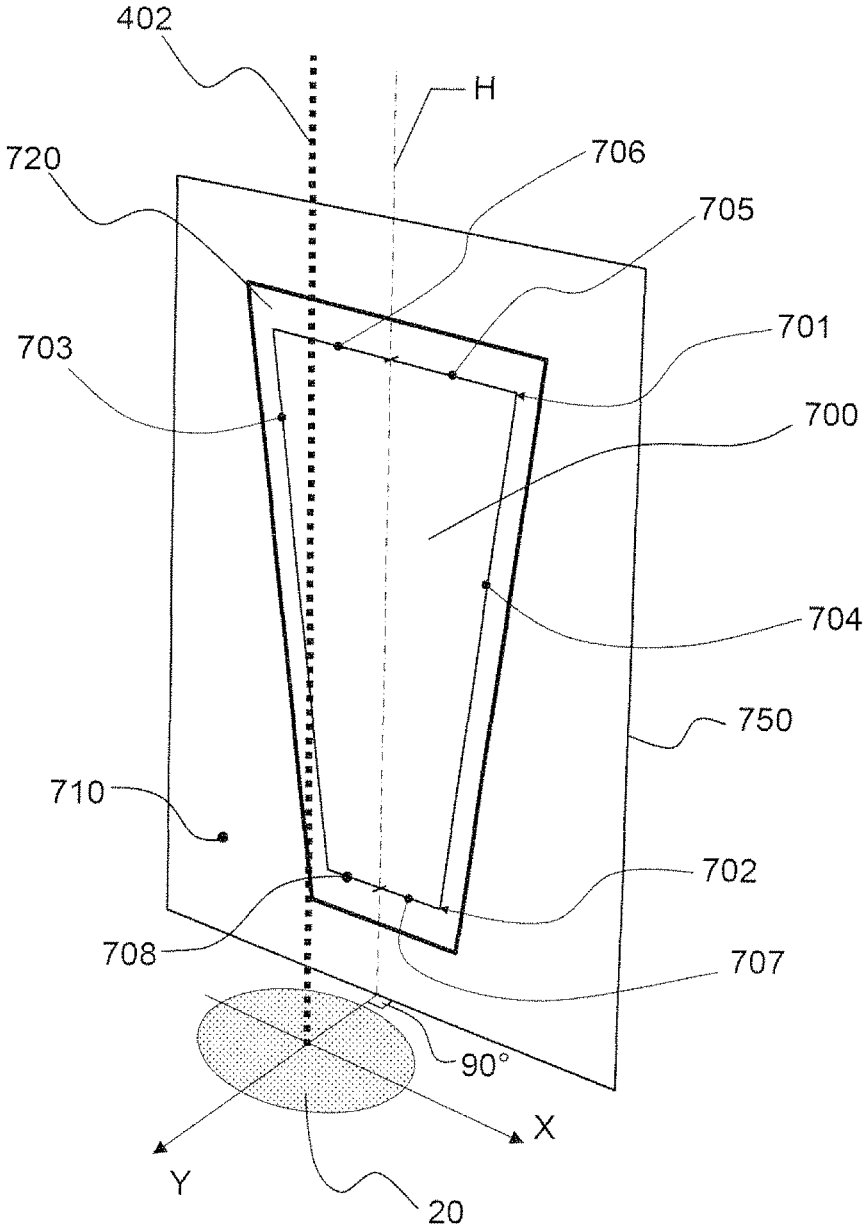
FIG. 7 shows the preferred embodiment of the detection device according to the invention with a preferred geometric shape and an arrangement of the sensor.

FIG. 7 shows a preferred embodiment of an electrostatic sensor according to the invention with a preferred geometric shape and a preferred arrangement. The continuous flat surface 750 of the sensor is placed in front of the non-printed drops and upstream of the inlet of the gutter 20. More precisely, the surface 750 is positioned parallel to the nominal trajectory 402 of the non-deflected jet, the directivity of which is to be monitored. The nominal trajectory of the non-deflected jet is projected in a straight line H perpendicularly on the surface plane 750 of the sensor.

The continuous flat surface 750 of the sensor is constituted by three distinct zones: a sensitive conductive zone 700 separated from a surrounding shielding zone 710 by an insulating zone 720.

The sensitive zone 700 is delimited by four edges: an upstream edge 701 and a downstream edge 702 connected by two lateral edges 703 and 704, which are rectilinear in FIG. 7. As illustrated in FIG. 7, the sensitive zone has a trapezoidal geometric shape. The sensitive zone 700 is connected to a current amplifier, not illustrated, which transmits the signal generated by the circulation of charges to a processing chain of the signal, likewise not illustrated.

The shielding zone 710 is conductive and connected to ground. It extends over the whole face of the sensor, except for a reserved-out part including the sensitive surface 700 augmented by a margin over its entire periphery.

The insulating zone 720 corresponds to the margin in question, defined hereinabove. The width of the part of the insulating zone vis-à-vis each edge of the sensitive surface can be different, and can even be variable along each edge.

The arrangement of the sensor is such that the upstream 701 and downstream 702 edges are substantially perpendicular to the nominal trajectory of the drops 402 issuing from the non-deflected jet.

The straight line H, which is the projection of the nominal trajectory 402 of the non-deflected jet on the flat surface 750 of the sensor perpendicularly to the latter, separates the upstream edge into two segments 705, 706 and the downstream edge into two segments 707, 708 on either side of the straight line H. As illustrated, the electrostatic sensor is symmetrical relative to the straight line H.

The upstream and downstream segments, located on the same side relative to the straight line H (705 and 707 on the one hand, or 706 and 708 on the other hand), are different in length. On the same side of H, on the one hand, the length of the shorter segment is less than or equal to the maximum permissible amplitude of trajectory offset of the jet along the axis X in the direction to the side of H considered, and on the other hand, the length of the longeer segment is substantially greater than this same amplitude.

In the preferred embodiment illustrated in FIG. 7, the smaller segments on either side of H (respectively the longer) are on the same edge and constitute the downstream edge 702 (respectively the upstream edge 701).

Application of the constraints expressed hereinabove, in the preferred embodiment illustrated in FIG. 7, results in defining a length of the downstream edge less than the diameter of the gutter and a length of the upstream edge greater than the diameter of the gutter, with a difference in lengths at least equal to twice the drop diameter.

A length of downstream edge 702 equal to around ⅔ of the inner diameter of the gutter 20 is preferably selected. This internal gutter diameter is in the present case greater than 10 times the diameter of a drop.

A length of the upstream edge 701 equal to around ⅔ of the inner diameter of the gutter is also preferably selected. The insulating zone vis-à-vis the upstream and downstream edges is a strip of constant width of the order of 3.5 drop diameter.

The insulating zone vis-à-vis the lateral edges 703 and 704 is preferably a strip of constant width equal to around twice the diameter of the drops. This width is less than that of the insulating zones vis-à-vis the upstream and downstream edges.

The height of the sensitive zone 700 is adjusted as according to the operating setting of the printer, specifically: drop size, drop frequency and jet speed. Given the values of the other parameters of the operating setting of the printer, this height has a preferred value of around 15 times the distance between drops in the jet.

The distance between the nominal trajectory of the non-deflected jet and the flat surface of the sensor delimited by the sensitive, insulating and shielding zones 700, 710, 720 is preferably the greatest possible to produce maximum tolerance to the instabilities of a jet which risk polluting the sensor; here it is substantially equal to ⅙ of the height of the sensitive zone.

As mentioned hereinabove, in the preferred embodiment, the test drops 310 are charged with inverse polarity to that of the drops intended for printing and at a value of the lowest possible electric charge causing the least possible deflection, while remaining measurable.

Given the relative upstream position of the sensor relative to the gutter 20 and the nominal distance d between the least deflected drop and the outer edge of the gutter which is here greater than around twice the diameter of the drops, at the level of the sensor the test drops 310 must remain in a surface of shape substantially identical to the test section 420 of FIG. 4.

For an average drop diameter of the order of 150 μm, there are the following values respectively for an electrostatic sensor illustrated in FIG. 7 and a recovery gutter 20 arranged downstream close to it:

- inner diameter of gutter 20≃1.5 mm,
- length of the downstream edge 702≃1 mm,
- length of the upstream edge 701≃2 mm,
- height of the insulating zone vis-à-vis the upstream and downstream edges≃500 μm,
- width of the insulating zone vis-à-vis the lateral edges≃300 μm,
- height of the sensitive zone 700≃4.8 mm, distance between flat surface 700, 710, 720 and the axis of the nominal trajectory of drops≃800 μm, deflection of the test drops 310 along the axis Y≃−100 μm, distance between the axis of the trajectories of test drops 310 of the flat surface of the sensor≃700 μm, distance of the test section 420: placed between ≃400 and 1300 μm from the sensor on the axis Y and +/−600 μm on the axis X.

Operation of the drop trajectory directivity detection device will now be described.

The processings applied to the signal measured from the sensor are different to produce evaluation of the offset of the jet trajectories along the axis X (parallel to the sensor) or along the axis Y (perpendicular to the sensor), and are successively described.

Evaluation of an Offset of Jet Trajectories Along the Axis X Parallel to the Sensor FIGS. 8A to 8C illustrate the time signals obtained after processing, as correctly charged drops (in the good synchronisation phase) pass in front of the sensor for three jet characteristic trajectories with a given offset along the axis X respectively zero or, otherwise expressed, centre (X=0), on the fixed detection limit (X=+600 μm) and beyond the fixed limit (X=900 μm). Throughout the rest of the explanation, it should be kept in mind that the scales of the ordinates of the curves presented in FIGS. 8A to 8C are not identical and that the units used on this axis are not directly current units, but are representative, after processing of the signal, of the amplitude of the electric current circulating to the sensor. Due to the geometrical shape and arrangement of the sensor in the embodiment illustrated in FIG. 7, the straight line H is likewise the axis of symmetry of the flat surface of the sensor: the signals illustrated in FIGS. 8A to 8C are therefore identical for symmetrical jet trajectory offsets relative to the straight line H.

In the examples of FIGS. 8A to 8C, the trajectories of test drops 310 remain in a plane substantially parallel to the sensor. To keep an account of the deflection value undergone by the test drops 310 (−100 μm along the axis Y), the plane in which the test drops 310 have their trajectories is positioned at −100 μm from the centre of the gutter along the axis Y.

FIG. 8A illustrates the zero offset or otherwise expressed an inlet position of test drops 310: they therefore remain in the plane of symmetry of the sensor. It is noted on the signal obtained after processing that the levels of the inlet and outlet peaks have absolute values Pe and Ps of the same order. The level of the outlet peak is however slightly lower than the level of the inlet peak (a value of 110 relative to a value of 146). This is due to the decrease in relative surface of a sensitive zone vis-à-vis the electrostatic influence area of charged drop: otherwise expressed, the more the drop advances from upstream to downstream the less its surface zone of influence is detected by the sensitive zone due to the trapezoidal shape of the sensitive zone, resulting in the natural decrease of the level of the peaks between the inlet Pe and the outlet Ps.

FIG. 8B illustrates a trajectory offset of test drops 310 at the detection limit to the right of H (or +600 μm). The entry conditions in the field of the sensor have changed little relative to the case 8A as the drops pass the upstream edge 705 vertically to a zone where its lateral end along X is further far from the trajectory offset. The level of the inlet peak Pe is therefore of the same order as that of the inlet peak of FIG. 8A. There is slight attenuation, of the order of 8% (ratio equal to 146−135/135). This is likewise due to the decrease in relative surface of sensitive zone vis-à-vis the electrostatic influence area of charged drop. On the contrary, the outlet peak level Ps has been clearly attenuated at the level of the outlet peak Ps of FIG. 8A. This attenuation is of the order of 33% (ratio equal to 110−74/110): it is due to the fact that the drops pass at the level of the lateral limit of the edge vertically to the downstream edge 702 (see dotted lines in FIG. 8B at the site of 702) and therefore opposite the lateral insulating strip 720. The charges caused on the sensitive surface have therefore sharply decreased.

FIG. 8C illustrates a trajectory offset of test drops 310 at the detection limit to the right of H (or +900 μm). When the test drops 310 are facing the sensitive zone vertically to the lateral limit of the upstream edge 701, they give an inlet peak Pe whereof the level is attenuated relative to that of FIGS. 8A and 8B: its order of magnitude remains nevertheless at a level comparable to that of the inlet peak of FIG. 8A (decrease by 25%). At the level of the downstream edge 702, the test drops 310 have gone beyond the insulating lateral strip 720 and pass vertically to the shielding 710. The outlet peak Ps is sharply attenuated: its level is diminished by 61% relatively at the level of the outlet peak of FIG. 8A. This being so, when the drops are facing the downstream edge 702, they remain sufficiently close to the latter to be able to generate an outlet peak Ps positioned substantially at the same instant as for the case of preceding offset of FIGS. 8A and 8B, but of a very low level. This case of offset illustrated in 8C corresponds practically to the limit of reliable exploitation of the signals.

It is also noted that for offsets greater than that of FIG. 8C (over 900 μm), the inlet peak is attenuated sharply, also the outlet peak disappears and is located imprecisely in the signal.

One can therefore evaluate the lateral offset along the axis X of the jet being displaced parallel to the sensor by a representative function of the difference between the levels of the inlet Pe and outlet Ps peaks extracted from the representative signal of the current circulating to the sensor as the test drops 310 pass close by. The decision to trigger an alarm signalling excessive offset of the jet, that is, non permissible, is the result of a test on the value provided by this function.

The function in the preferred embodiment is the ratio in absolute value between level of inlet peaks and outlet peaks Ps/Pe and the test consists of verifying that the value obtained is greater than a single predetermined threshold value R. In a configuration where the shape of the sensitive zone of the sensor discriminates the direction of displacement of the drops, the value of the function of the levels of inlet Pe and outlet Ps peaks can be compared to two predetermined threshold values which correspond respectively to the instances of trajectories offset to the right and left of the straight line H.

FIG. 8D shows a curve representative of the absolute value of the ratio Pe/Ps (|Ps/Pe|) according to the lateral offset jet trajectory along the axis X, the trajectories concerned of the test drops 310 all being offset by a distance of −100 μm along the axis Y. It is noted that the ratio Pe/Ps remains substantially constant and maximum when the jet starts to move away from the nominal trajectory, then prompts a substantially linear decrease when the amplitude of the offset approaches the lateral end of the downstream edge 702 of the sensitive zone of the sensor. So, for a predetermined value R of the order of 0.55, the detection zone along the axis X corresponds to that desired +/−600 μm. Verifications made by the inventors show that the relative behaviour of the inlet and outlet peaks described hereinabove remains substantially identical when the offset of the trajectories of the jet along the axis Y varies within the detection limits.

Evaluation of an Offset of Jet Trajectories Along the Axis Y Perpendicular to the Sensor An offset of the jet along the axis Y causes approach or distancing of the test drops 310 relative to the flat surface of the sensor. The nominal trajectory of the test drops 310 is entered at a distance of 700 μm from the sensor. The expected effect of the offset of the jet along the axis Y is a variation of the amplitude of the inlet and outlet peaks of the representative signal of the current circulating in the sensor.

If this offset of the jet along the axis Y is considered while it remains in the plane of symmetry of the sensor (X=0), the test drops 310 will remain in the permissible safety zone if they do not approach one another less than 400 μm from the sensor (or −300 relative to the nominal test drops trajectory situated at 700 μm from the sensor) and if they do not move away from one another more than 1300 μm (+600 μm relative to the nominal trajectory). The nominal trajectory is indicated in vertical dotted lines in FIG. 9A.

Figure 9A:
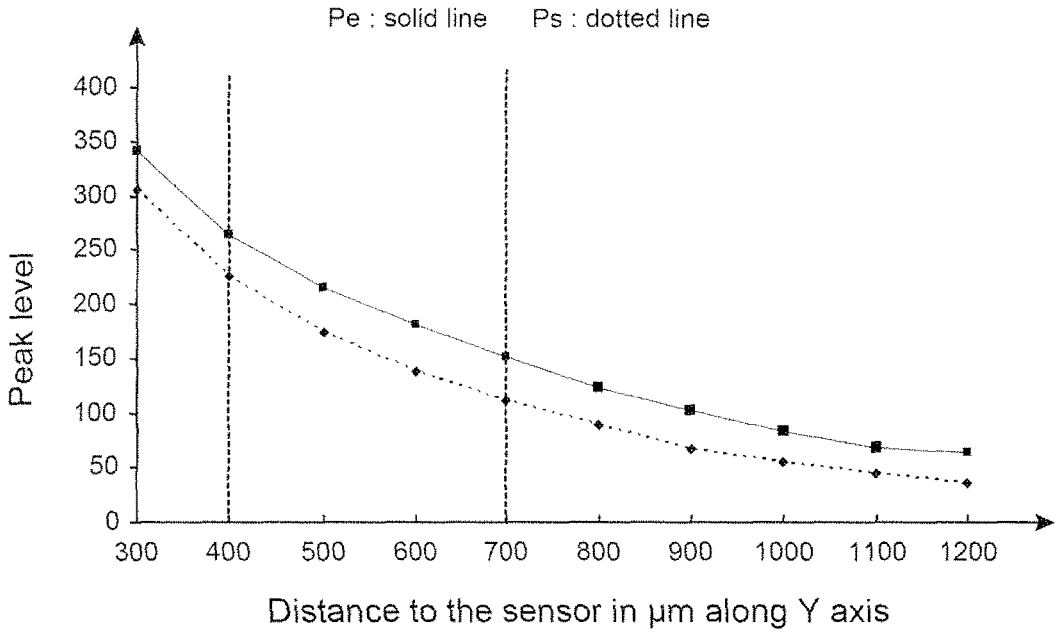
FIGS. 9A and 9B show the rate of the values of determined inlet peaks Pe and outlet peaks Ps as well as their Pe/Ps ratio as a function of the offset of trajectories of drops perpendicularly to the flat surface of the sensor according to FIG. 7 relative to a nominal trajectory.

FIG. 9A shows experimental curves representative of the absolute levels of Pe and Ps when the offset of the trajectories along the axis Y evolves. Here, too, the units used on the ordinate "Level of the peak" of the curve are not directly electrical current units, but are representative, after processing of the signal, of the amplitude of the electrical current circulating to the sensor at the extremes of the peaks. It is seen that the level of the inlet peak Pe varies between around +350 for decentering by −400 μm and 64 for decentering by +500 μm (amplitude representative of the current for decentering relative to the nominal value of 700 μm). This level can therefore serve as criterion for a test generating the excessive decentering alarm on this axis; the test consisting of verifying that the level of the greatest peak, corresponding to Pe in the preferred embodiment, is between a minimum value Nmin and a maximum value Nmax.

In FIG. 9A, it is noted that:

- each of the levels of the inlet Pe and outlet Ps peaks decreases progressively as a function of the distance of the trajectories relative to the sensor,
- the difference between the levels of the two inlet Pe and outlet Ps peaks remains approximately constant.

Figure 9B:
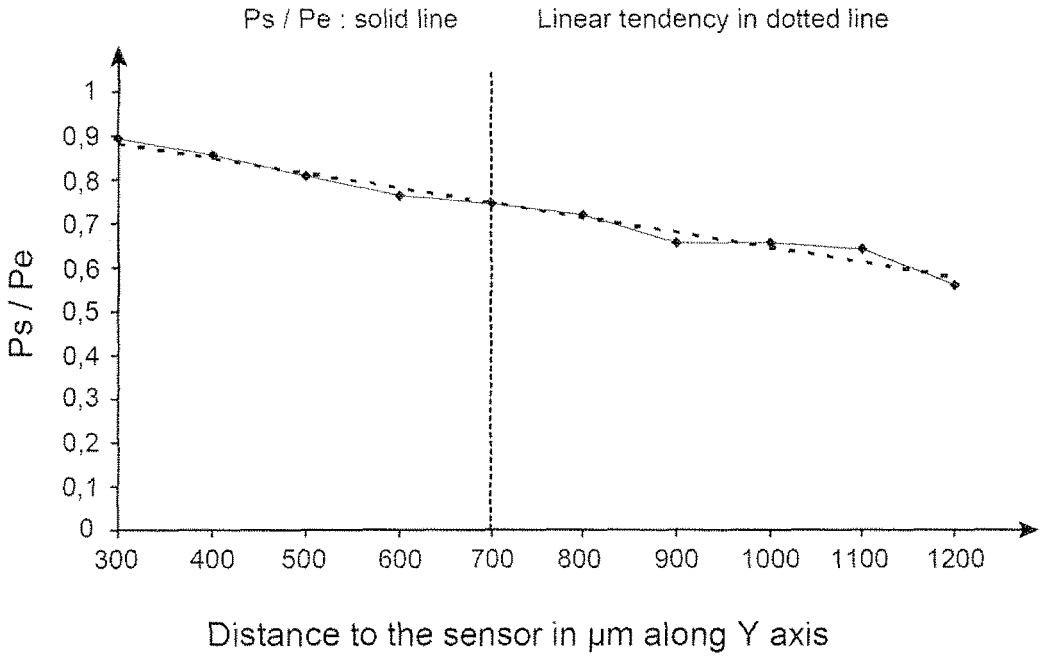

The calculated ratio Ps/Pe illustrated on the curve of FIG. 9B passes from 0.9 for an offset of −400 μm on the axis Y to 0.56 for an offset of +500 μm on the same axis Y, when the jet is centred on the axis X.

Detection of an Excessive Bidirectional Offset (Not Tolerated) of Jet Trajectories As explained earlier, evaluation of an offset of the jet in a predetermined safety surface 501 (FIG. 5) can be dome solely from evaluation of the levels of the inlet and outlet peaks of the signal coming from the detection device according to the invention described earlier relative to test drops 310 which define a reference trajectory.

Therefore, the level of the inlet peak indicates the distance between the flat surface of the sensor and the trajectory of test drops 310 and for this distance, the ratio Ps/Pe indicates the lateral offset of the trajectory of test drops 310.

According to the invention an alarm procedure can also be established from the jet offset evaluations. This alarm procedure must lead to a binary output form between two situations:

- either the test drops 310 are localised in a zone guaranteeing that the drops issuing from the continuous ink jet do not interact with the wall of the gutter,
- or the test drops 310 are localised in the complementary zone where the risk of interaction between drops and the gutter exists (this zone is that referenced 500 in FIG. 5). The latter situation is that according to which an alarm is triggered.

Preferably, the alarm procedure is launched after assurance that the best charge phase is utilised, resulting in optimal signals. In fact, poor charge synchronisation relative to the break-up of the continuous ink jet could lead to aberrant and unstable peak levels, unusable for tests and alarm.

The steps of the procedure which triggers an alarm when the jet approaches the limit of the permissible safety zone are the following:

1—emission of a sequence of test drops 310;

2—elaboration of the representative signal of the current generated in the detection device when test drops 310 pass in front of the electrostatic sensor;

3—evaluation of the level of the inlet Pe and outlet Ps peaks present in the signal and calculating of the absolute value of the ratio Ps/Pe (|Ps/Pe|);

4—comparison between the higher level of the peak P (of Pe or Ps) with predetermined values Nmin and Nmax: if P>Nmax or P<Nmin the alarm is triggered and the procedure is abandoned. The higher peak is the inlet peak Pe with a sensor and arrangement according to FIG. 7;

5—OTHERWISE (Nmin>P>Nmax) selection of a predetermined value R (from a memorised table or a function of calculation) as a function of the level of the peak P;

6—comparison between the ratio |Ps/Pe| and the value R: if |Ps/Pe|<R the alarm is triggered and the procedure is abandoned;

7—OTHERWISE the procedure terminates. In this step 7/, the trajectory of the jet is therefore considered permissible.

Phase Searching and Measuring the Speed of the Drops Issuing From the Jet

With the same detection device illustrated in FIG. 7, it is possible to search for the best charge phase of the drops and to measure their speed. In fact, in the signals obtained after emission of charged test drops 310 with different phases, the highest peak level is representative of the quality of the charge. On the other hand, the time elapsed between the extremum of the inlet and outlet peaks is that taken by the drops in passing opposite the sensor. Thus, knowing the effective length of the sensitive zone makes it possible to calculate the speed of the test drops 310 passing in front of the sensor. The experimental measurements achieved show that the quality of the characteristics of the inlet and outlet peaks (representativeness of the level, localisation precision of the peaks) remains sufficient for performing phase search and measuring the jet speed, whatever the drift of the jet inside the safety zone.

Thanks to the invention, the combination of the phase search, speed measuring and evaluation of real position of jet can therefore be carried out in the same test sequence. The advantage of this is to reduce the time allocated to control measurements of a printer according to the invention equipped with an electrostatic sensor and signal-processing means as hereinabove. This is all the more significant since during this control time normal operation of the printer, that is, the production of printing, is interrupted. Otherwise expressed, in reducing the control time dedicated to implement the steps according to the invention, the availability of the printer is increased.

Figure 11A:
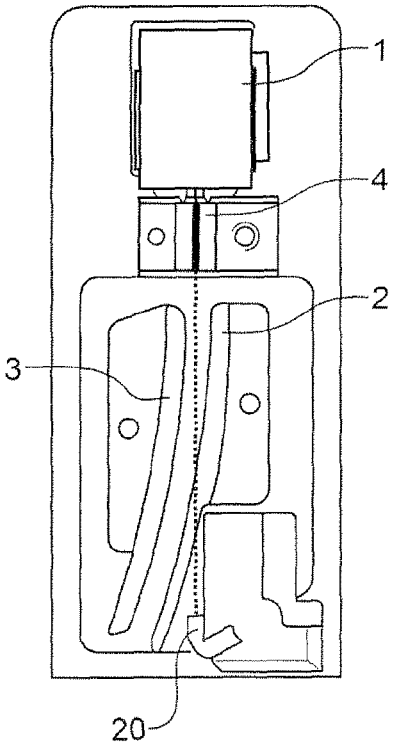
FIGS. 11A and 11B show respectively in a frontal view and in side view according to T, a print head using deflected continuous ink jet technology according to the invention comprising curved deflection electrodes.
Figure 11B:
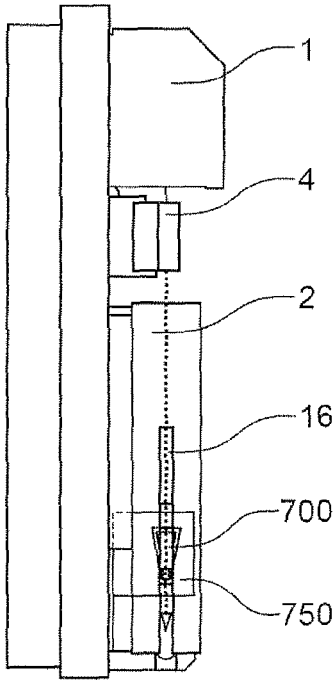

An advantageous arrangement of an electrostatic sensor according to the invention in a continuous jet print head is shown in FIGS. 11A and 11B.

In the prior art, the implementation of electrostatic sensors in print heads required the length of the flying path of the drops to be increased in the print head, as it was necessary to physically interpose a sensor between the charge electrode and the gutter. The bulkiness of a sensor of the prior art was increased by the necessity to apply shielding around the sensitive core. For example, the patent EP 0 362 101 describes an electrostatic U-shaped sensor whereof the sensitive zone is placed at the bottom of the slot. The exterior of this U-shaped sensor is completely shielded, allowing effective protection vis-à-vis the electrostatic environment prevailing in the head. Similarly, for flat sensors, exposed directly to the electrostatic environment, the prior art proposes applying a shielding surface vis-à-vis the functional surface of the sensor with jet trajectories passing between the flat surface of the sensor and the applied shielding surface. Such a configuration is for example that of print heads marketed under the brand "Serie Imaje Serie 9020".

But this increasing of the flying path length of the drops is not desirable, as it can result in degradation of printer performance, especially imprecision on the position of the printed drops.

The print head illustrated in FIGS. 11A and 11B is that disclosed in application FR 2 821 291 with the added implementation of the electrostatic sensor 750 according to the invention.

FIG. 11A shows in frontal view a print head platen with the drop generator 1, the charge electrode 4, the deflection plate 2 kept at 0V and the high voltage deflection electrode (also called deflection plate) 3. These two deflection plates 2, 3 are curved, substantially parallel and close to one another to increase the efficiency of deflection. This configuration requires opening of a slot 16 in the plate 2 to let the non-deflected or slightly deflected drops pass through. FIG. 11B is a side view in the direction of observation T with the plate 3 and the plate 2 being viewed respectively in transparency and in semi-transparency. The sensor 750, is placed as follows:

- above the gutter 20, as far as possible from the nozzle to maximise measuring precision but likewise at sufficient distance from the gutter inlet to minimise the risk of pollution generated by the splashing coming from the gutter;
- the flat surface 750 of the sensor is perpendicular to the deflection plane of the drops;
- behind the deflection plate kept at 0V and at a very close distance to the latter. As explained hereinabove, the deflection electrode therefore plays the role of effective shielding vis-à-vis the sensor plane, without adding a additional shielding function.

The gutter can advantageously be placed more upstream than the lower end of the deflection plates. The casing of the sensor and the gutter can be mechanically linked for easier mutual positioning and to make the specifications of the detection zone solely defined by construction (without adjustment during assembly).

Implementation of the sensor in the head, as in FIGS. 11A and 11B, does not therefore increase the flying path length of drops and adds to the printer the function of monitoring of drift in the jet directionality without altering the performance of the printer. Further, accessibility to the gutter and to the sensor for maintenance is optimal.

The invention which has just been described improves in particular directivity detection of trajectories of drops due to possible precise real-time evaluation of the actual bidirectional shifted position of a trajectory of charged drops relative to a nominal trajectory at a given location of the latter (advantageously close to the recovery gutter).

The advantages of a continuous ink jet printer according to the invention relative to ink jet printers of the prior art are the following:

- precisely evaluating the bidirectional shift of trajectories of ink drops issuing from the jet of the drop generator of the print head;
- triggering an alarm if the position of drop passing near a given sensor location with a monitored drop trajectory approaches limits or exits from a safety zone and in particular, exits from the inlet of the recovery gutter;
- providing the user of a continuous jet printer, with reliable information on the recovery of non-printed drops, if required as a complement to information from a flow sensor in the gutter (any drops caught by the gutter with sufficient safety margin, or any significant risk for some drops of striking the edge of the gutter is detected)
- searching for the best charge phase synchronisation and measuring the drop speed.

In addition, executing the invention increases neither the complexity of the head nor its bulk. The flight time of drops circulating in the print head is not modified by detection according to the invention: printing performances are therefore preserved. Arrangement of the sensor does not impair accessibility in the print head which therefore remains optimal for maintenance. Integration of the sensor according to the invention in a print head with curved deflection electrodes creates effective shielding of said sensor vis-à-vis electromagnetic perturbations without disturbing passing of the deflected drops.

Other improvements can be made without as such departing from the scope of the invention.

In particular, if in the detailed description the trajectory of which the directivity has been detected is the trajectory of the non-deflected ink drops leading the former to the centre of the recovery gutter, the invention can also be applied to monitore the directivity of drop trajectories around a nominal trajectory, optionally deflected, not necessarily directed to the recovery gutter.

Also, the polarity of the charged drops detected according to the invention can be identical to that of the deflected printed drops or alternatively take on opposite values.

Figure 10A:
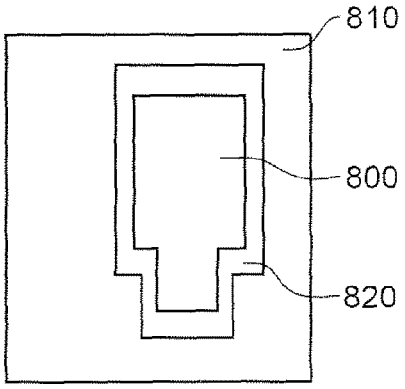
FIGS. 10A and 10B show variants of geometrical shapes of the electrostatic sensor; examples of alternative configurations of the functional face of the sensor.
Figure 10B:
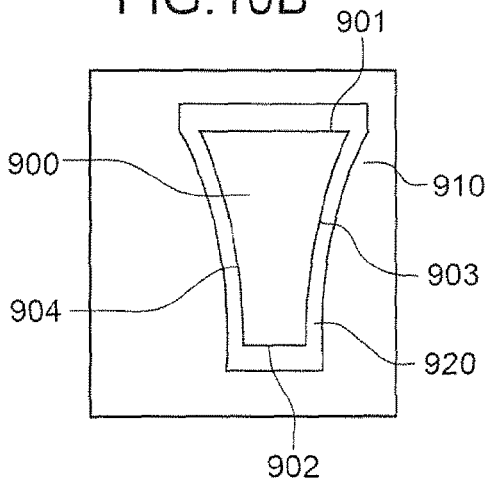

Also, the electrostatic sensor described precisely hereinbefore is a sensor whereof the sensitive zone and the insulating zone have trapezoidal shapes on its flat surface: detection can be adjusted by adapting the shape of the flat surface delimited by the sensitive zone and of the insulating strips, for example according to the shapes illustrated in frontal view in FIGS. 10A and 10B. In these FIGS. 10A and 10B the electrostatic sensor has a sensitive zone 800 or 900, which is symmetrical, an insulating zone 820 or 920 enclosing the sensitive zone which defines a substantially homothetic shape and a shielding zone 810, 910 enclosing the insulating zone which is not symmetrical. The shape of the sensitive zone 800 of FIG. 10A is delimited by two rectangles superposed on one another. The shape of the sensitive zone 900 of FIG. 10B is delimited by two edges 901 and 902 which constitute the upstream and downstream edges in detection according to the invention. These two upstream and downstream edges 901, 902 are connected to one another by lateral edges 903, 904 of curved profile.

What is claimed is:

1. A directivity detection device for detection of trajectories of drops issuing from a liquid jet, the drops being charged electrically, the device comprising:

an electrostatic sensor comprising an electrically sensitive portion configured to detect an electrical charge, the electrically sensitive portion made of an electrically conductive material, the sensitive portion surrounded by an insulating portion made of electrically insulating material, the insulating portion being surrounded by an electric shielding portion made of electrically conductive material and connected to ground; the zones of the sensor delimiting at least one continuous flat surface, the sensitive zone of the sensor comprising at least four edges including an upstream edge and a downstream edge connected to one another by two lateral edges, the arrangement of the sensor being such that:

the upstream and downstream edges are substantially perpendicular to the direction of the nominal trajectory of the drops and are each cut into two segments by a straight line H which is the geometric projection of the nominal trajectory on the flat surface;

for each of the sides of the sensor delimited by the straight line H, the segment of the upstream edge and the segment of the downstream edge are of different lengths, the length of the longer segment being at least equal to the maximum permissible amplitude of the offset of trajectories to the side of the straight line H considered, relative to the nominal trajectory and the length of the shorter segment being at most equal to the maximum permissible amplitude of the offset of trajectories to the side of the straight line H considered, relative to the nominal trajectory;

a signal-processing unit configured to process the electrical signal generated by the electrical charges of the drops through movement detected by the sensor, the signal processing unit being configured to:

evaluate the level of an inlet peak Pe and the level of an outlet peak Ps of the representative signal of the electrical current derived from a charge in movement detected respectively at the level of the upstream edge and of the downstream edge of the sensor, calculate the value of a representative function of the difference between the levels of Pe and Ps, determine a first comparison of the value of the function with at least one first predetermined constant value or a range of predetermined values, and determine a second comparison of the level of the higher inlet peak Pe or outlet peak Ps relative to one another with at least one second predetermined constant value, the predetermined values being characteristic of the nominal trajectory of the drops, wherein the first comparison is indicative of the actual position of a trajectory of drops in a plane parallel to the flat surface of the sensor and the second comparison is indicative of the actual position of the same trajectory of drops in a plane perpendicular to the flat surface of the sensor.

2. The detection device according to claim 1, wherein the representative function of the difference between the levels of Pe and Ps in absolute value is the ratio Pe/Ps or the difference Pe-Ps.

3. The detection device according to claim 1, wherein the signal-processing unit comprises an evaluation unit configured to evaluate the time-interval between the inlet peak Pe and the outlet peak Ps for deducing the speed of drops at the site of the sensor.

4. The detection device according to claim 1, wherein the arrangement of the sensor is such that its sensitive zone is symmetric relative to the straight line H which is the geometric projection of the nominal trajectory of drops.

5. The detection device according to claim 1, wherein the arrangement of the sensor is such that its sensitive zone is non-symmetrical relative to the straight line H which is the geometric projection of the nominal trajectory of drops.

6. The detection device according to claim 1, wherein the difference in length, in absolute value, between the segment of the upstream edge and the segment of the downstream edge located on the same side relative to the straight line H is at least greater than one diameter of the drops.

7. The detection device according to claim 1, wherein the arrangement of the sensor is such that its flat surface is distant from the nominal trajectory of the drops by a distance between twice the diameter of the drops and one height of the sensitive zone.

8. The detection device according to claim 1, wherein the height of the sensitive zone is between about 3 and about 100 times the spacing between successive drops in the jet.

9. The detection device according to claim 1, wherein the height of the insulating zone enclosing the sensitive zone at the level of the upstream and downstream edges is between about 0.5 and about 10 times the diameter of the drops.

10. The continuous ink jet printer according to claim 1, wherein the test drops are charged with an inverse polarity of the drops deflected to be printed.

11. An electrostatic sensor comprising:

an electrically sensitive portion configured to detect an electrical charge, the electrically sensitive portion being made of electrically conductive material, the electrically sensitive portion comprising, from a front view of the flat surface, at least two edges substantially parallel to one another, and a straight line perpendicular to the edges which passes through the middle of one of these edges cuts the other edge to define two segments of different length on either side;

an electrically insulating portion made of electrically insulating material, the electrically insulating portion surrounding the sensitive zone;

an electrical shielding portion made of electrically conductive material and connected to ground, the electrical shielding portion surrounding the electrically insulating portion;

wherein the portions of the sensor are delimited by at least one continuous flat surface.

12. A continuous ink jet print head comprising:

a drop generator fitted with an ink-ejection nozzle configured to eject a continuous jet;

a charge electrode arranged downstream of the ejection nozzle and configured to electrically charge drops of the continuous jet;

a pair of deflection electrodes spaced apart from one another and arranged downstream of the charge electrode, the pair of deflection electrodes configured to selectively deflect charged drops intended for printing;

a recovery gutter of non-deflected drops and at least one electrostatic sensor according to claim 11.

13. The print head according to claim 12, wherein the deflection electrodes each have an active incurved surface, the surface of one of deflection electrodes comprising a pass through slot configured to allow the non-deflected drops pass, the electrostatic sensor being arranged between the slot and the recovery gutter.

14. The print head according to claim 12, wherein the electrostatic sensor is arranged proximate to and upstream of the recovery gutter of non-deflected drops, the downstream edge of the electrically sensitive portion being distant from the inlet plane of the gutter by a minimum distance of between about 0.5 mm and about 5 mm, and wherein the drops have a diameter of between about 70 μm and about 250 μm.

15. The print head according to claim 12, wherein the arrangement of the sensor is such that its flat surface is substantially perpendicular to the deflection plane of the drops and opposite of the deflection directions, and wherein the deflection directions are defined as being the directions between the zero deflection trajectory and the plurality of deflection trajectories activated for printing.

16. The print head according to claim 12, wherein the arrangement of the sensor is such that its flat surface is substantially parallel to the deflection plane of the drops and to the rear of the ink jet, the front of the ink jet being defined with reference to the front face of the head.

17. The print head comprising two electrostatic sensors according to claim 11, wherein one of the sensors is arranged such that its flat surface is substantially perpendicular to the deflection plane of the drops and opposite of the deflection directions, and wherein the deflection directions are defined as being the directions between the zero deflection trajectory and the plurality of deflection trajectories activated for printing, while the other of the sensors is arranged such that its flat surface is substantially parallel to the deflection plane of the drops and to the rear of the ink jet, the front of the ink jet being defined with reference to the front face of the head.

18. A continuous ink jet printer comprising a print head as claimed in claim 12 and signal-processing unit configured to process the electrical signal generated by the electrical charges of the drops through movement detected by the sensor, the signal processing unit being configured to:

evaluate the level of an inlet peak Pe and the level of an outlet peak Ps of the representative signal of the electrical current derived from a charge in movement detected respectively at the level of the upstream edge and of the downstream edge of the sensor, calculate the value of a representative function of the difference between the levels of Pe and Ps, determine a first comparison of the value of the function with at least one first predetermined constant value or a range of predetermined values, and determine a second comparison of the level of the higher inlet peak Pe or outlet peak Ps relative to one another with at least one second predetermined constant value, the predetermined values being characteristic of the nominal trajectory of the drops, wherein the first comparison is indicative of the actual position of a trajectory of drops in a plane parallel to the flat surface of the sensor and the second comparison is indicative of the actual position of the same trajectory of drops in a plane perpendicular to the flat surface of the sensor.

19. The continuous ink jet printer according to claim 18, wherein the drops detected by the detection device are test drops charged by the charge electrode during normal operation of the printer and inserted into a sequence of drops deflected by the deflection electrodes to be printed.

20. The continuous ink jet printer according to claim 18, wherein the signal-processing unit is coupled to an alarm which is triggered if at least one of the comparisons results in confirming one of the values or of the range of predetermined values being exceeded, the triggering of the alarm signalling the risk of not recovering all of the non-deflected ink drops by the gutter.

21. The continuous ink jet printer according to claim 18, further comprising a complementary analysis unit of the ink flow in the gutter for detecting defects, the defects including a defective gutter function or a jet out of a gutter.

22. The continuous ink jet printer according to claim 18, comprising a complementary analysis unit configured to analyze the ink flow in the gutter for detecting defects, the defects including a defective gutter function or a jet out of a gutter, the complementary analysis unit comprising a resistivity analysis unit configured to analyze a resistivity of the ink vein circulating in the ink return circuit immediately after the inlet of the gutter.

23. The continuous ink jet printer according to claim 18, comprising a charge phase varying unit configured to vary the charge phases of the drops, the signal-processing unit being adapted, during variation of the charge phases, to determine the highest peak of the representative signal of the electric current derived from a charge detected at the level of the same edge of the sensor, a charge electrode signal being set during operation of the printer based on the charge phase corresponding to the representative signal which causes the highest peak.

24. An electrostatic sensor comprising:

an electrically sensitive portion configured to detect an electrical charge, the electrically sensitive portion made of electrically conductive material, the electrically sensitive portion of the sensor comprising, from a front view of the flat surface, at least two edges substantially parallel to one another and having different lengths, and a straight line perpendicular to the edges which passes through the middle of one of the edges also passes through the middle of the other edge;

an electrically insulating portion made of electrically insulating material, the electrically insulating portion surrounding the sensitive zone;

an electrical shielding portion made of electrically conductive material and connected to ground, the electrical shielding portion surrounding the electrically insulating portion;

wherein the portions of the sensor are delimited by at least one continuous flat surface.

25. The electrostatic sensor according to claim 24, wherein the electrically sensitive portion has, from a front view of the flat surface, a trapezoidal geometric shape, and wherein the electrically insulating portion which surrounds the electrically sensitive portion has a quasi homothetic trapezoidal shape.

26. The electrostatic sensor according to claims 11 or 24, wherein the lateral edges of the electrically sensitive portion which join the two edges parallel to one another have, from a front view of the flat surface, a curved, rectilinear or stepped profile.

* * * * *

UNITED STATES PATENT AND TRADEMARK OFFICE

CERTIFICATE OF CORRECTION

PATENT NO. : 8,511,802 B2
APPLICATION NO. : 13/387354
DATED : August 20, 2013
INVENTOR(S) : Odin It is certified that error appears in the above-identified patent and that said Letters Patent is hereby corrected as shown below:

On the Title Page, Item (54) and in the Specification, Column 1, at line 1, Title, Change "DIRECTLY" to --DIRECTIVITY--.

In the Claims

In column 24 at line 3, In Claim 5, change "non-symmetrical" to --non-symmetric--.

In column 24 at line 33, In Claim 11, change "these" to --the--.

In column 24 at line 64, In Claim 14, change "and" to --an--.

In column 26 at line 7, In Claim 21, change "comprising" to --comprising,--.

Signed and Sealed this
Second Day of September, 2014

Michelle K. Lee

Michelle K. Lee
*Deputy Director of the United States Patent and Trademark Office*